US007406898B1

(12) United States Patent
Hall, Jr.

(10) Patent No.: US 7,406,898 B1
(45) Date of Patent: Aug. 5, 2008

(54) ADJUSTABLE PLIERS HAVING SLIDABLY MOUNTED JAW

(76) Inventor: Herbert L. Hall, Jr., 1371 Pleasant Valley Rd., Newark, OH (US) 43055

( * ) Notice: Subject to any disclaimer, the term of this patent is extended or adjusted under 35 U.S.C. 154(b) by 0 days.

(21) Appl. No.: 11/725,610

(22) Filed: Mar. 20, 2007

Related U.S. Application Data

(63) Continuation-in-part of application No. 10/933,754, filed on Sep. 3, 2004, now Pat. No. 7,191,688.

(60) Provisional application No. 60/500,116, filed on Sep. 3, 2003.

(51) Int. Cl.

| | |
|---|---|
| ***B25B 7/04*** | (2006.01) |
| ***B25B 7/10*** | (2006.01) |
| ***B25B 7/12*** | (2006.01) |
| *B25B 9/04* | (2006.01) |

(52) U.S. Cl. ..... 81/411; 81/413; 81/358

(58) Field of Classification Search ..... 81/358–360, 81/364–366, 373, 393, 411, 413, 416
See application file for complete search history.

(56) References Cited

U.S. PATENT DOCUMENTS

| | | | | |
|---|---|---|---|---|
| 623,337 | A | | 4/1899 | Rydberg |
| 785,586 | A | | 3/1905 | Wulst |
| 1,085,198 | A | | 1/1914 | Finney |
| 1,162,136 | A | | 11/1915 | Chapman |
| 1,207,064 | A | | 12/1916 | Metcalf |
| 1,244,966 | A | | 10/1917 | Eifel |
| 1,344,629 | A | | 6/1920 | Fowler |
| 1,367,711 | A | | 2/1921 | Nortwed |
| 1,540,464 | A | | 6/1925 | Edwards |
| 1,546,139 | A | | 7/1925 | Lévéque |
| 1,680,956 | A | | 8/1928 | Simonsen |
| 1,862,817 | A | | 6/1932 | Eifel |
| 1,866,426 | A | * | 7/1932 | Siegrist ..... 81/356 |
| 2,084,633 | A | | 6/1937 | Erickson |
| 2,156,529 | A | | 5/1939 | Day |
| 2,375,082 | A | | 5/1945 | Colley |
| 2,382,606 | A | | 8/1945 | Clark |
| 2,397,095 | A | | 3/1946 | Emmettt |
| 2,844,061 | A | | 7/1958 | Hendrickson |
| 3,161,094 | A | | 12/1964 | Johnson |
| 3,803,954 | A | | 4/1974 | Lenker |
| 4,094,215 | A | | 6/1978 | Hudson |
| 5,176,049 | A | | 1/1993 | Neff |
| 5,351,584 | A | | 10/1994 | Warheit |
| 5,461,951 | A | | 10/1995 | Putsch |

(Continued)

*Primary Examiner*—David B Thomas
(74) *Attorney, Agent, or Firm*—MacMillan, Sobanski & Todd, LLC

(57) ABSTRACT

A hand held tool includes a slotted handle having a jaw end, a medial section, and a gripping end, the medial section including a slot having a gear tooth rack. An operative handle has a pinion gear end and a gripping end, with pinion gear being fixed with respect to the operative handle, and the pinion gear being positioned in the slot and having a toothed portion and a non-toothed portion. An operative jaw is slidably mounted with respect to the slotted handle to cooperate with the jaw of the slotted handle to group a workpiece, the operative jaw having one or more guide mechanisms to maintain the orientation of the jaw with respect to the slot as the jaw slides and as torque is applied to the operative jaw when a workpiece is gripped.

8 Claims, 19 Drawing Sheets

U.S. PATENT DOCUMENTS

| | | | | |
|---|---|---|---|---|
| 5,535,650 | A | 7/1996 | McNatt | |
| 5,832,793 | A | 11/1998 | Collins | |
| 5,845,551 | A | 12/1998 | Putsch | |
| 6,026,716 | A | 2/2000 | Orlosky | |
| 6,125,725 | A | 10/2000 | Fox et al. | |
| 6,155,142 | A | 12/2000 | Bally et al. | |
| 6,178,855 | B1 | 1/2001 | Bally et al. | |
| 6,199,459 | B1 | 3/2001 | Azkona | |
| 6,227,081 | B1 | 5/2001 | Bally et al. | |
| 6,497,165 | B1 | 12/2002 | Schulz et al. | |
| 6,502,482 | B1 | 1/2003 | Putsch et al. | |
| 7,191,688 | B1 * | 3/2007 | Hall, Jr. | 81/411 |

* cited by examiner

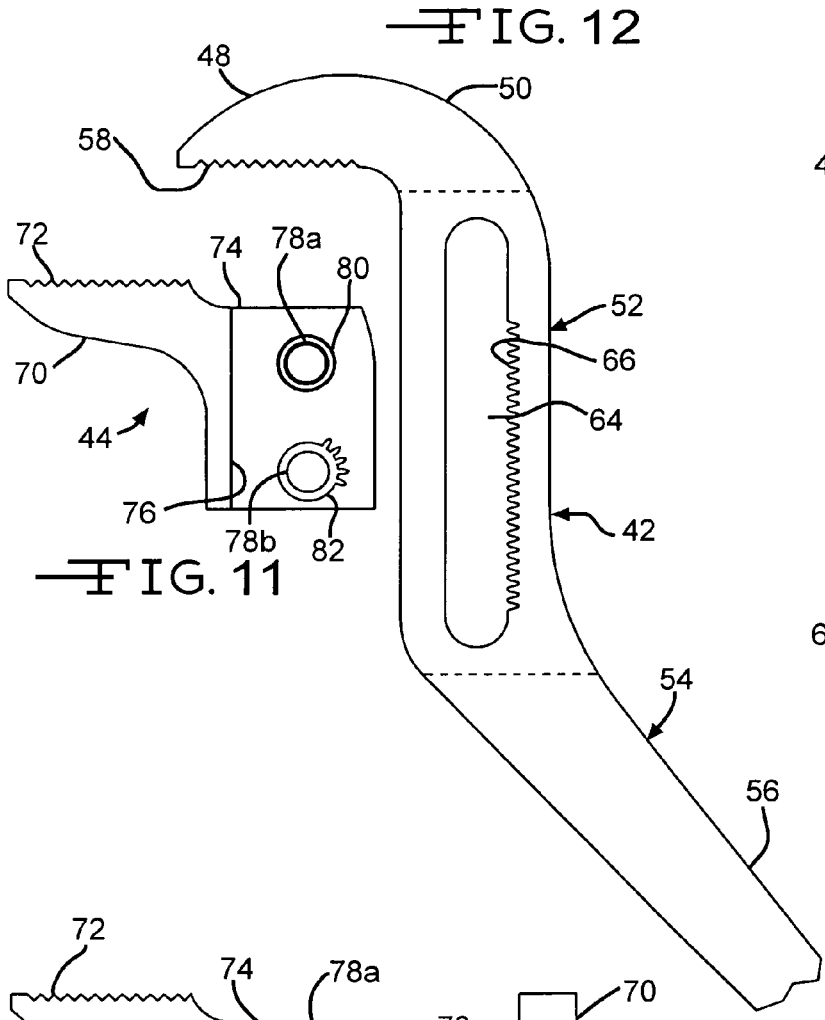
FIG. 12
FIG. 11
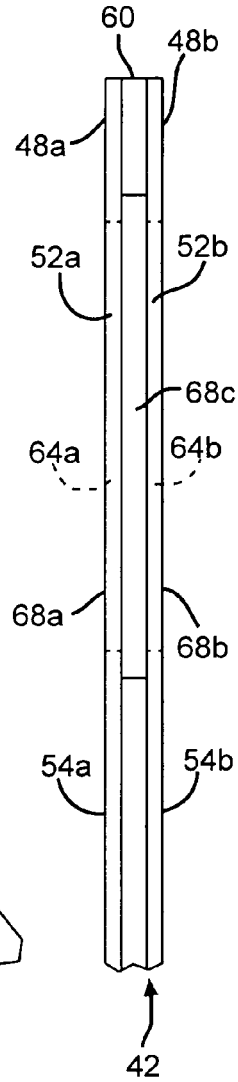
FIG. 13
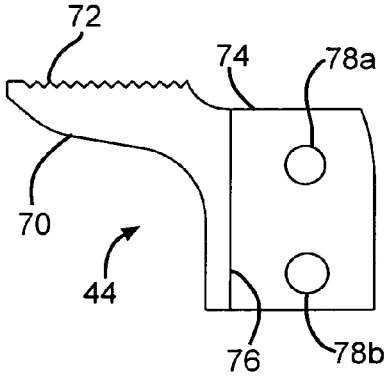
FIG. 14
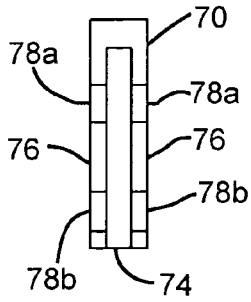
FIG. 15

FIG. 25
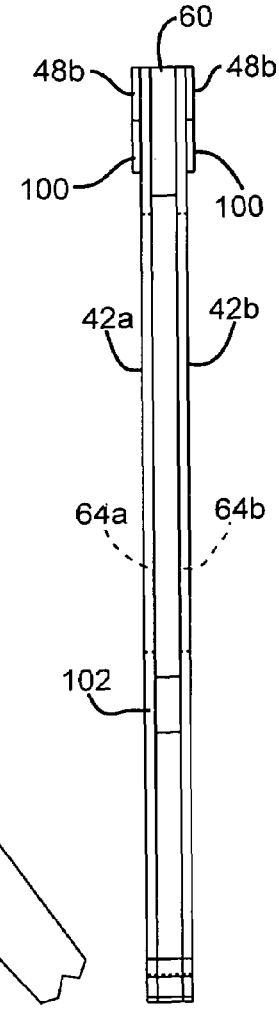
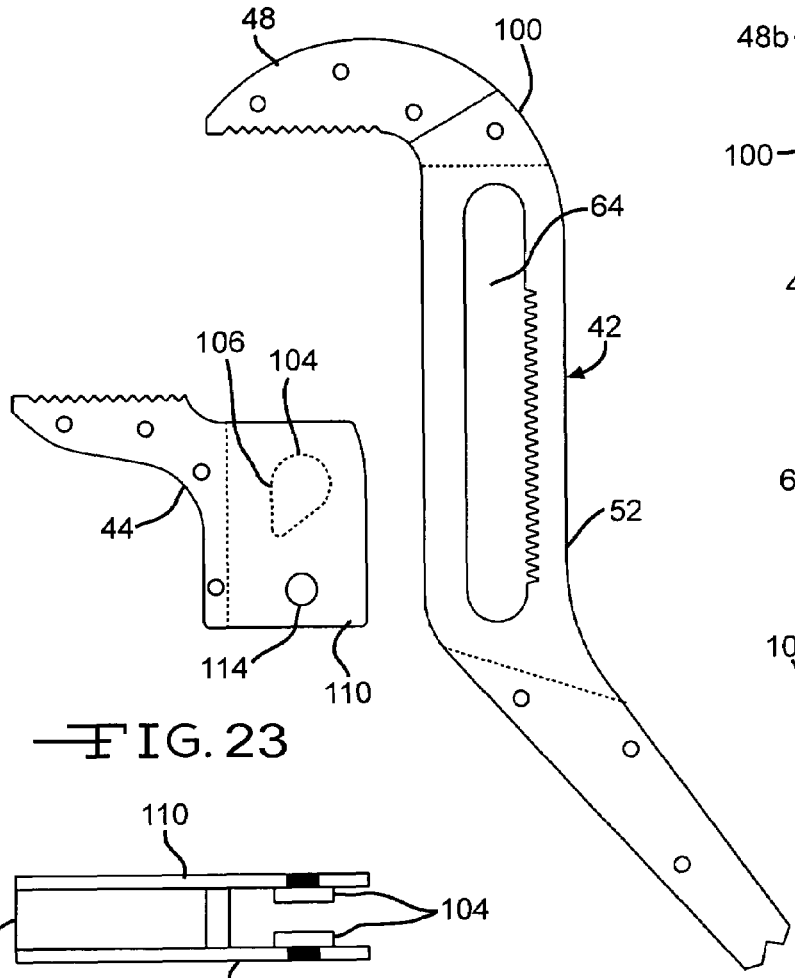
FIG. 23
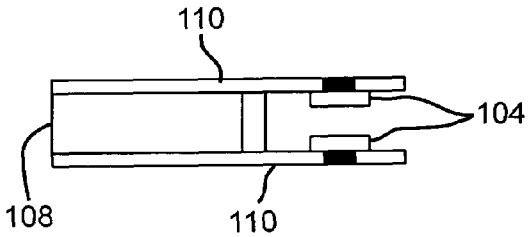
FIG. 24
FIG. 22

ADJUSTABLE PLIERS HAVING SLIDABLY MOUNTED JAW

RELATED APPLICATIONS

This application claims priority from provisional patent application, Ser. No. 60/500,116, filed Sep. 3, 2003. This application is a Continuation-In-Part of application Ser. No. 10/933,754 filed Sep. 3, 2004, now U.S. Pat. No. 7,191,688, entitled FORCE AUGMENTATION AND JAW ADJUSTMENT MEANS FOR HAND HELD TOOLS, and issued Mar. 20, 2007, all of which is incorporated in the present application in its entirety.

TECHNICAL FIELD

The present invention relates primarily to pliers and wrenches. More particularly, this invention relates to pliers and wrenches in which the jaw opening is variable and manually adjustable over a range of selectable jaw gap settings.

BACKGROUND OF THE INVENTION

There are at least two general styles of pliers. One style of prior art pliers is generally known within the tool trade as a slip-joint pliers or tongue-and-groove pliers as popularized by Channellock, Inc. A second style of prior art pliers is known as a plier-wrench since it combines features of both pliers and wrenches.

Yet another style of tool is the plier-wrench, which is a two-handled parallel-jaw wrench that has the general overall shape and appearance of pliers. The smooth-faced jaws of this hand tool maintain the jaws in a parallel relationship with respect to each other while being opened and closed, in the manner of wrenches. The prior art plier-wrench is two-handled in the manner of pliers.

SUMMARY OF THE INVENTION

In one aspect, the present invention relates to a hand held tool. The hand held tool includes a slotted handle having a jaw end, a medial section, and a gripping end, wherein the jaw end defines a jaw, the medial section includes a slot having a gear tooth rack, the toothed rack defining a plurality of alternating teeth and spaces, and the gripping end defining a handle. The tool also includes an operative handle having a pinion gear end and a gripping end, wherein the pinion gear end includes a pinon gear fixed with respect to the operative handle, the pinion gear being positioned in the slot, the pinion gear having a toothed portion and a non-toothed portion, the toothed portion having at least one tooth shaped to engage the spaces of the gear tooth rack in a rolling motion, and the non-toothed portion being structured to enable sliding of the pinion gear along the slot when the pinion gear teeth are not engaged with the gear tooth rack. The tool also includes an operative jaw slidably mounted with respect to the slotted handle to cooperate with the jaw of the slotted handle to grip a workpiece, the operative jaw having one or more guide mechanisms to maintain the orientation of the jaw with respect to the slot as the jaw slides and as torque is applied to the operative jaw when a workpiece is gripped, the jaw having a post member fixed to the jaw and extending through the pinion gear to pivotally mount the pinion gear with respect to the slotted handle.

BRIEF DESCRIPTION OF THE DRAWINGS

FIG. 11 is a plan view of the slidable jaw of the pliers of FIG. 10.

FIG. 12 is a plan view of the slotted handle of the pliers of FIG. 10.

FIG. 13 is a side view of the slotted handle of FIG. 12.

FIG. 14 is a plan view of the slidable jaw, without the pinion gear or bearing.

FIG. 15 is a side view of the slidable jaw of FIG. 14.

FIG. 22 is a plan view of another embodiment of an adjustable pliers having a slidably mounted jaw, and having the operating handle as an inside layer.

FIG. 23 is a plan view of the slidable jaw of FIG. 22.

FIG. 24 is a side view of the slidable jaw of FIG. 23.

FIG. 25 is a side view of the slotted handle of FIG. 22.

DETAILED DESCRIPTION OF THE INVENTION

For the purpose of this invention disclosure the term pliers describes a hand tool in which the jaws are pivotable about an operative axis. The term plier-wrench describes a hand tool in which the jaws may be tightened onto an object, and where the jaw faces are maintained in a parallel relationship with each other.

A force augmentation, or force multiplication, of a plier-wrench at its jaw is achieved by means of the lever arm principle which states that input torque must equal output torque. Torque is defined as the product of the normal force applied to, or exerted by, a moment arm and the distance from the fulcrum at which the force acts. The input torque applied to the hand-grips, at the end of the handles, can be expressed as: $\text{Force}_1 \times \text{Moment Arm}_1$ while the output torque of the short tang can be expressed as: $\text{Force}_2 \times \text{Moment Arm}_2$, where the Moment $\text{Arm}_1$ is longer than the Moment $\text{Arm}_2$ by several times. When the two expressions are set as an equality, the force exerted by the tang onto the operative jaw will be several times that of the hand grip force applied to the operative handle at a distance of Moment $Arm_1$.

Advantages of the present hand held tool include one or more of the following: clamping force multiplication over other simple lever plier designs (due to a larger Moment $Arm_1$/Moment $Arm_2$ ratio); low cost of manufacturing; reduced dirt contamination compared with a tongue and groove design; ease of jaw gap adjustment procedure; relatively efficient force transfer between the operative handle and movable jaw; and little or no need for a wide medial section to accommodate the side by side arrangement of a movable jaw and operative handle.

According to one aspect, the preset invention provides novel rack and pinion gear hand tools which has a number of benefits. The term "tool" as used in this specification includes hand held tools where a very high jaw force is required, and also includes tools where only a modest gain in jaw force is required over that of standard slip-joint pliers.

According to another aspect of the present invention, some hand held tools comprises wrenches which maintain their jaws in a parallel relationship. In other aspects, different styles of pliers are also presented as part of this invention disclosure. In still other aspects, the present invention relates to hand held tools that incorporate a pivoting motion in their operation. Thus, the subject invention is not meant to be limited to the exemplary embodiments, but to the scope of the invention itself.

Figure 1:
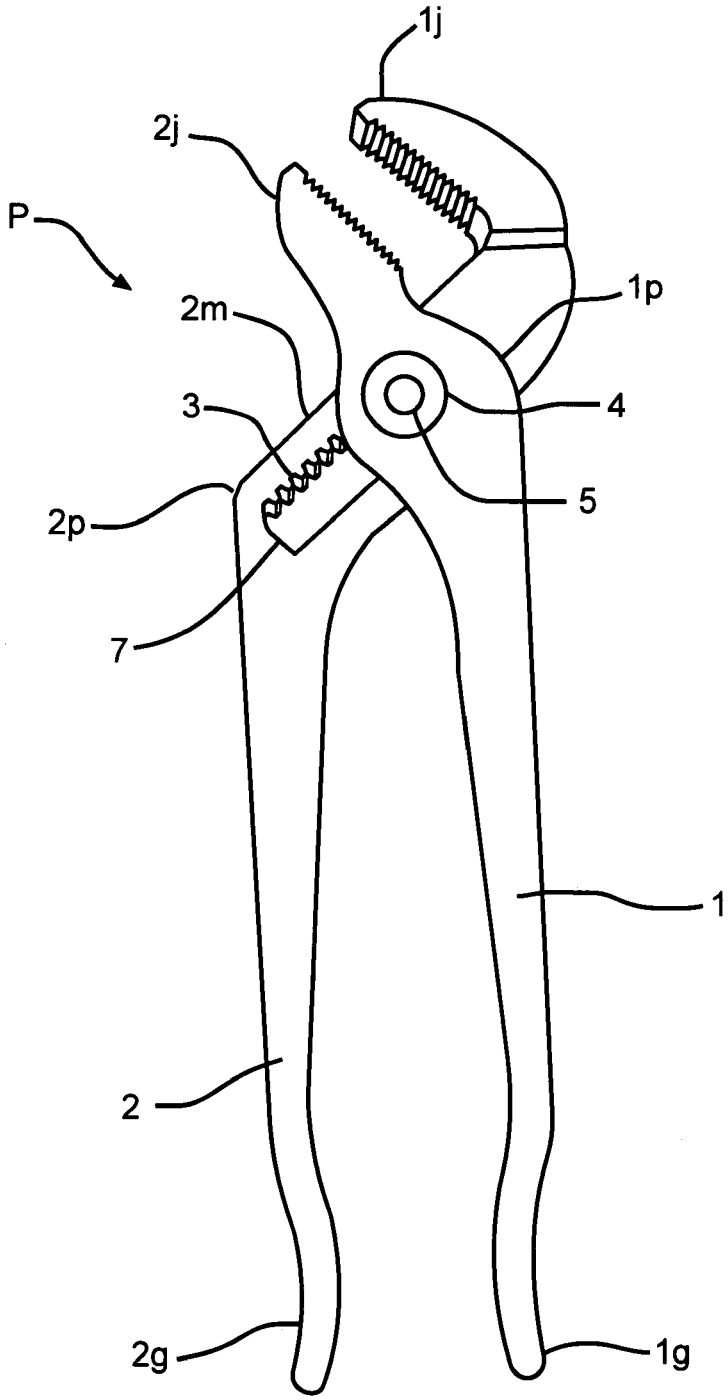
FIG. 1 is a top plan view of one hand held tool.

Referring first to the Figures, FIG. 1 shows one embodiment of a hand held tool of the present invention comprising a Plier assembly P. The plier assembly P includes an operative handle 1 and a slotted handle 2. The operative handle 1 has a jaw, or pivot, end 1*p* and a gripping end 1*g*. The pivot end 1*p* defines a jaw 1*j*.

The slotted handle 2 has a jaw, or pivot, end 2*p* and a griping end 2*g*. The pivot end 2*p* defines a jaw 2*j*. The jaw end 2*p* of the slotted handle 2 defines a slot 7. The slot 7 extends along a medial section 2*m* of the slotted handle 2. The slot 7 has a first side 7*s* which defines a toothed side, or rack, 3 and a second, or plain, side 7*p*. The toothed rack 3 defines a plurality of alternating teeth 3*t* and spaces 3*s*.

Figure 2:
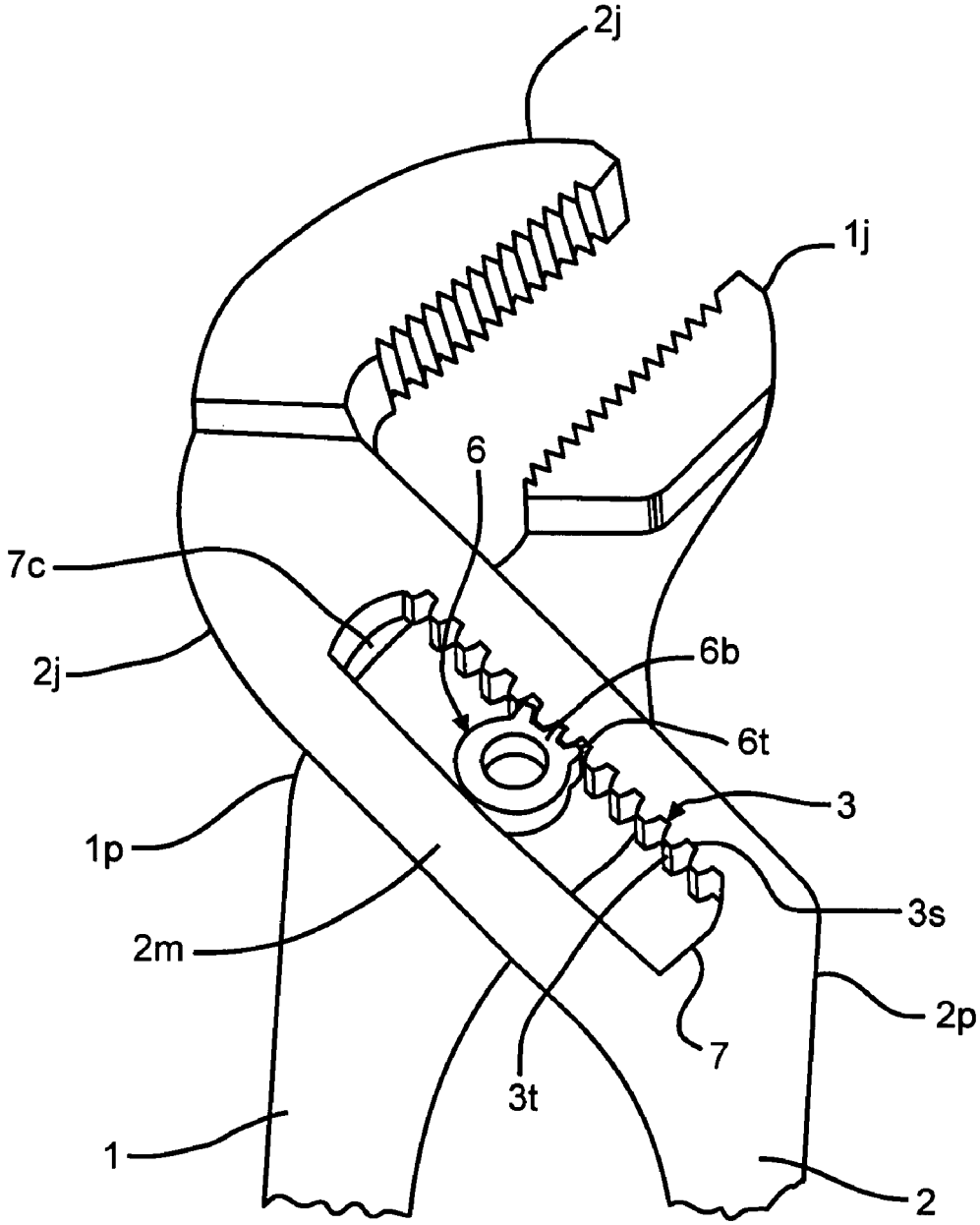
FIG. 2 is a partial, perspective view of the hand held tool shown in FIG. 1 where a flanged post is removed and a partially-toothed pinion gear is shown engaging a rack
Figure 3:
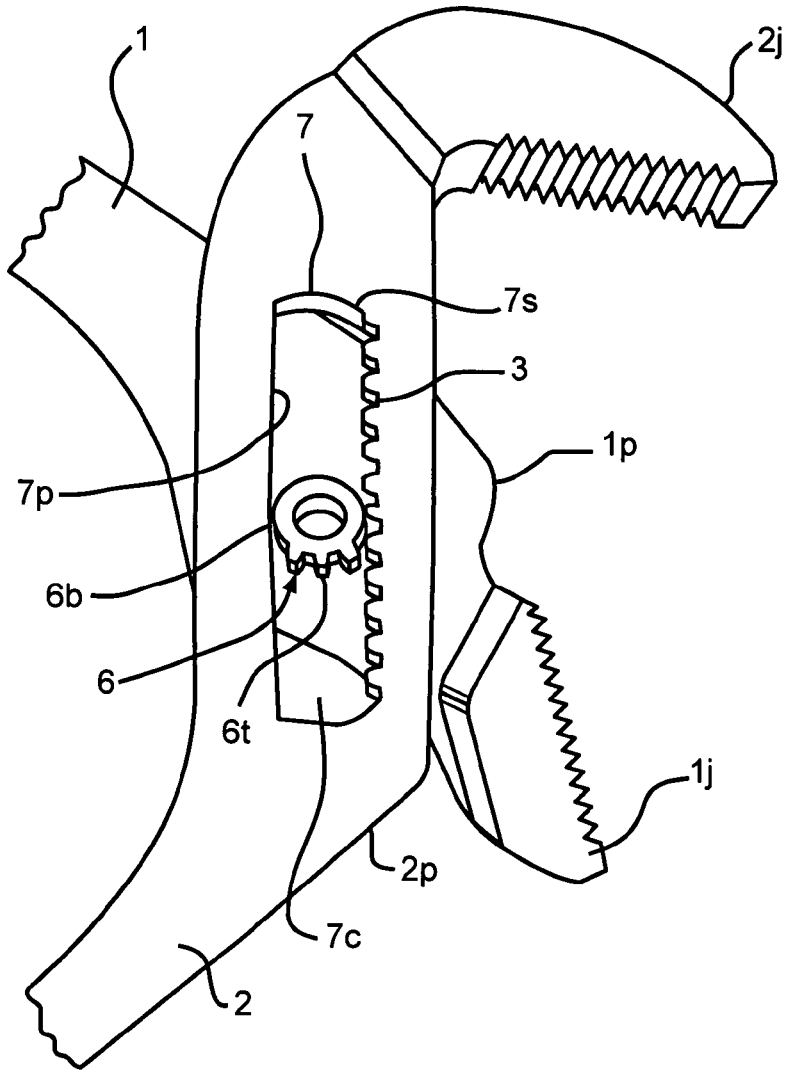
FIG. 3 is a partial perspective view of the hand held tool shown in FIG. 1 where showing the tool in a jaw gap setting position.

The operative handle 1 also includes a pinion gear 6, as best seen in FIGS. 2 and 3, which is operatively mounted to the jaw end 1*p* of the operative handle 1. The pinion gear 6 is axially positioned within the slot 7 to slideably move in the slot 7. It should be understood, however, that other means of securing the pinion gear 6 to the jaw end 1*p* of the operative handle 1 are within the contemplated scope of the present invention.

In the embodiments shown, a post member 5, such as, for example, a flanged post 5, secures the operative handle 1 to the slotted handle 2. In the embodiment shown, a nut 4 is coaxially mounted on the post member 5. FIG. 2 shows an opposite side of the Plier assembly P with the post member 5 removed. The pinion gear 6 includes at least one, and in certain embodiments, a plurality of teeth 6*t*, which are suitably shaped to engage the spaces 3*s* between the teeth 3*t* of the rack 3. In FIG. 2 the pinion gear 6 is shown engaging the rack 3 in a set, or engaged, position.

FIG. 3 shows the Plier assembly P in a jaw gear setting position where the teeth 6*t* of the pinion gear 6 are non-engaged with the teeth 3*t* of the rack 3.

In the embodiment of the present invention shown in FIGS. 1-3, a gain in jaw force is realized. A first force augmentation is due to the shortening of the jaw's moment arm length. This allows a higher moment arm ratio between the handle and the jaw which, in turn, yields higher jaw forces. A second jaw force augmentation entails treating the workpiece being grasped by the pliers as one bar in a 2-bar link and the tool as the second bar in the 2-bar link. When the included angle between the two bars, in the 2-bar link, is greater than 90 degrees, the linkage begins to behave as a quasi-toggle link, with a concomitant dramatic increase in force being applied to, and in-line with, the output link (workpiece) as the included angle approaches 180 degrees. In the Plier assembly P embodiment shown in FIGS. 1-3, the linkage is never permitted to travel over-center in the manner of a locking toggle. As such, the Plier assembly P may be quickly clamped onto and released from workpiece.

The rack and pinion gear pivot mechanism makes shortening of the operative jaw's moment arm, the quasi-toggle action, and a sequential jaw gap setting procedure possible. The partially-toothed pinion gear 6 is integral with the jaw end 1*p* of the operative handle 1 cooperates with the rack 3 and slot 7 in the slotted handle 2. The pinion gear teeth 6*t* preferably comprise about 90 degrees, or ¼, of the gear's total circumferential distance. The rest of the circumference of the gear 6 is left toothless; i.e., down to the root diameter of the pinion gear, where the root diameter is understood to be the diameter of the pinion gear less the height of the teeth.

The root diameter of the pinion gear 6 corresponds to the nominal width of the slot 7; i.e., where the nominal width is understood to extend from the top of the teeth to the opposing and smooth side 7*p* of the slot 7. The gear teeth 6*t* are aligned with the jaw-handle 1 such that, when the handles 1 and 2 are separated at nearly their widest separation distance, a body portion 6*b* of pinion gear 6 is aligned with a centerline 7*c* of the slot 7. The gear teeth 6*t* are no longer in engagement with the adjacent rack 3, thereby enabling the operative jaw handle 1 with the integral pinion gear 6 to be slid along the slot 7 until arriving at a new jaw gap position. Once the new jaw position is reached, the operative jaw handle 1 is once again rotated into an operative position. Once the operative jaw-handle 1 is rotated into the operative position, the pinion gear teeth 6*t* are then in engagement with a new set of the rack's teeth 3*t*. The new set of teeth 3*t* correspond to a different jaw gap setting, thereby retaining the desirable sequential jaw gap setting procedure.

The rack teeth 3*t* define the elongated side 7*s* of the slot 7 closest to the jaws 1*j* and 2*j*. The smooth side p7 of the slot 7 is left plain or non-toothed. When the Plier assembly P is made to operate, by closing the handles 1 and 2 and the jaws 1*j* and 2*j* upon each other, the operative jaw-handle 1 with the integral pinion gear 6 creates a rolling-translating pivot axis (i.e., prolate cycloid motion) which coincides with the rack's straight-line pitch dimension. Therefore, the jaw's moment arm pivot axis is offset toward the jaw by one half of the pitch diameter of the pinion gear 6. This effectively shortens the jaw's moment arm length and increases its jaw force. One advantage is that the lower jaw's moment arm no longer extends all the way to the centerline of the elongated slot as is the case in prior art slip-joint pliers.

Figure 9:
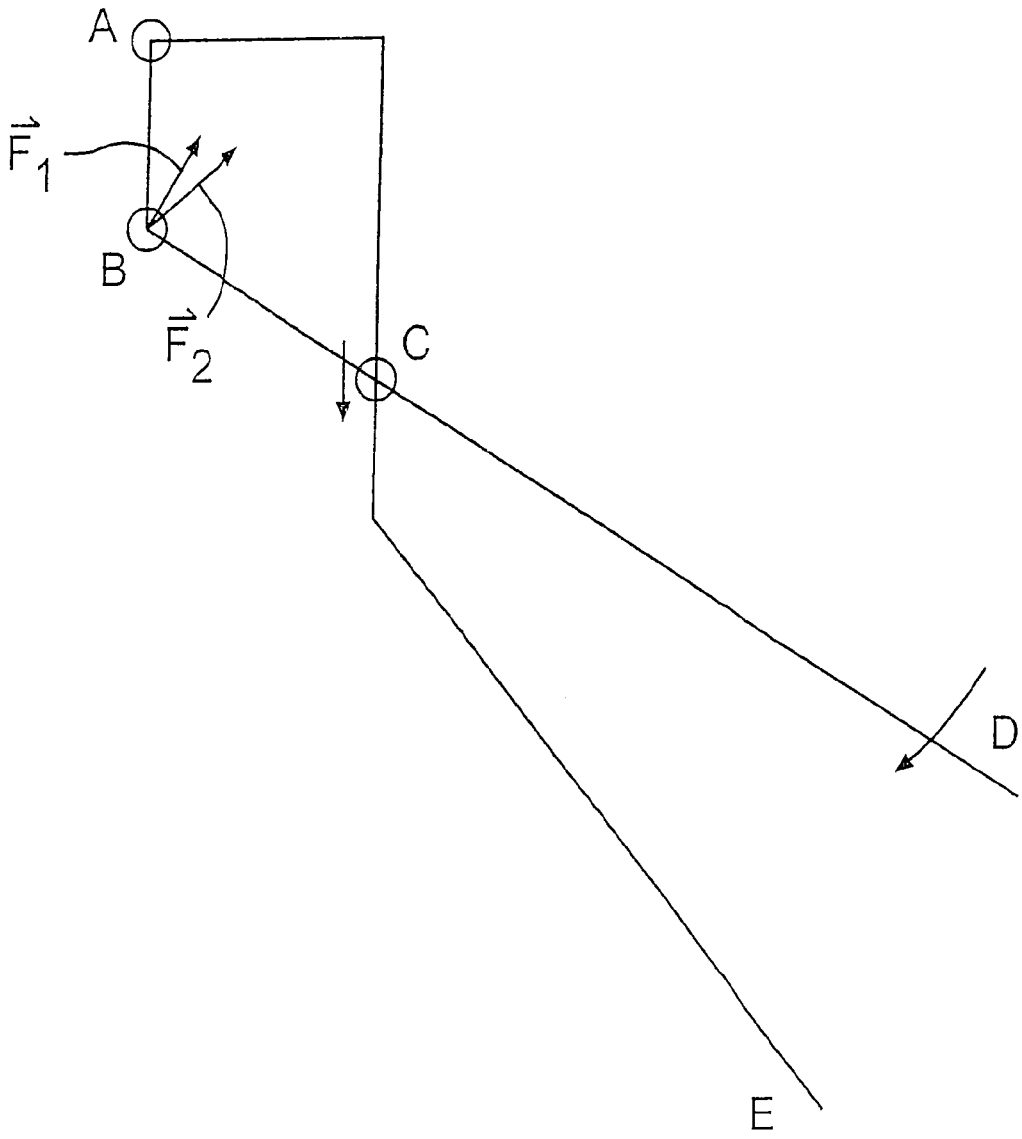
FIG. 9 is a schematic illustration of forces on hand held tools.

Referring to FIG. 9, a schematic illustration of hand tools is shown as having 2-bar links. The present invention provides a unique 2-bar link where the pivot axis C also translates. The two principal links are: AB and BD, with BC as one arm, or link, of lever arm BD. Link AB represents the workpiece in contact with the jaws at position A and position B. Link BD represents the operative jaw-handle. Position C and its arrow represents the translational-pivot characteristic of prolate cycloid motions; in contrast, prior art slip-joint pliers only utilize a simple pivoting action at position C. Position D represents the downward hand grip force. For the sake of simplicity, jaw-handle AE is assumed to be static and fixed, when in practice, it is understood that an equal but opposite force to D is customarily applied at E as well.

Force $vector_1$ represents the magnitude and direction of the force exerted by conventional prior art plier jaws at position B. Force $vector_2$ represents a larger magnitude and more advantageous direction of force at position B that is afforded by the present invention. The larger force is derived by virtue of the shorter effective moment arm of BC due to the handle's pivot axis being offset to one side of the slot, as opposed to being centered within the slot according to prior art conventions. A more advantageous direction of force is derived by virtue of the prolate cycloid motion of BD. A simple pivoting lever arm exerts a force at B which is perpendicular to BC. Force $vector_2$, as a result of a prolate cycloid motion, is less than 90 DEG; i.e., the Force $vector_2$, more nearly bisects angle ABC. When angle ABC is more nearly bisected, significantly higher forces are developed in links AB and BC. Hence, there is a quasi-toggle link action.

The incorporated rack and pinion mechanism results in a Plier assembly P where additional jaw force augmentation is obtained within the dimensional constraints of the pliers.

As the jaws 1*j* and 2*j* are clamped onto a workpiece, not only does the operative handle 1 rotate, but the operative handle 1 also moves in a rectilinear fashion as well.

The simultaneous, dual, rolling-pivot action of the rack and pinion provides a straight-line motion of the pivot axis away from the jaws 1 and 2, and causes a straightening of a first link (the lower jaw) and the second link (workpiece). This additional degree of freedom, even though small in magnitude, over a conventional pliers' fixed pivot axis, permits the desirable quasi-toggle action to occur.

In order to further encourage the development of a 2-bar link, quasi-toggle, action with the Plier assembly P, there are at least three pivot points; one at the joint connecting the two links, and one at the opposite ends of the two links. Since the workpiece is the output link, its two contact points with the upper and lower jaws must be allowed to pivot, even if only slightly. One means of ensuring that this occurs with flat-sided work pieces such as hex head bolts and nuts is to incorporate shallow, smooth-faced, notches in the jaws' toothed gripping surfaces. In certain embodiments, the included angle between the two faces of the notches is preferably between about 121 degrees and about 135 degrees, and in certain embodiments, preferably about 125 degrees.

One advantage of this embodiment of the present invention is that the measured notch, or included angle, allows a minor rocking, or pivoting of the hex corners to occur prior to the application of torque to the bolt or nut. Round objects such as pipes and rods have a natural tendency to rock or roll and therefore, do not require the use of notches. Conventional pipe wrenches utilize the quasi-toggle action when clamping onto round work pieces (pipes); however, jaw clamping force does not ensue until a torque has been applied to the round workpiece. Conversely, the plier assembly P takes advantage of the quasi-toggle principle and provides a clamping force independent of any applied torque. Additionally, the jaw-handle orientation is preferable for most applications when compared to that of prior types of pipe wrench designs.

Another advantage is that when the plier assembly P clamps squarely onto the corners of a hex head bolt or nut, as opposed to the flats, the clamping force is directed in a more advantageous direction. The notches are more resistant to a caming or ramping action than if the jaws are applying a clamping force normal to the faces of the hex workpiece (fastener, fitting, etc.).

Yet another advantage of clamping squarely onto the corners of hex work pieces is that the plier assembly's jaws do not need to be opened as far in order to obtain another purchase on the hex workpiece. This helps to speed the loosening and tightening of these times. Smooth-faced notches are non-marring where aesthetics of the hex workpiece is important, while, the remainder of the jaws' faces may still be left toothed for other gripping applications.

Referring now to FIGS. 4-7, another embodiment of a plier assembly PA is shown. The plier assembly PA includes an operative handle 8 and a slotted handle 9. The operative handle 8 includes i) a handle portion, comprised of a jaw, or pivot, end 8*p* and a gripping end 8*g*, and ii) an operative jaw 14. In the embodiment shown, the pivot end 8*p* is operatively and removeably connected to the operative jaw 14.

Figure 5:
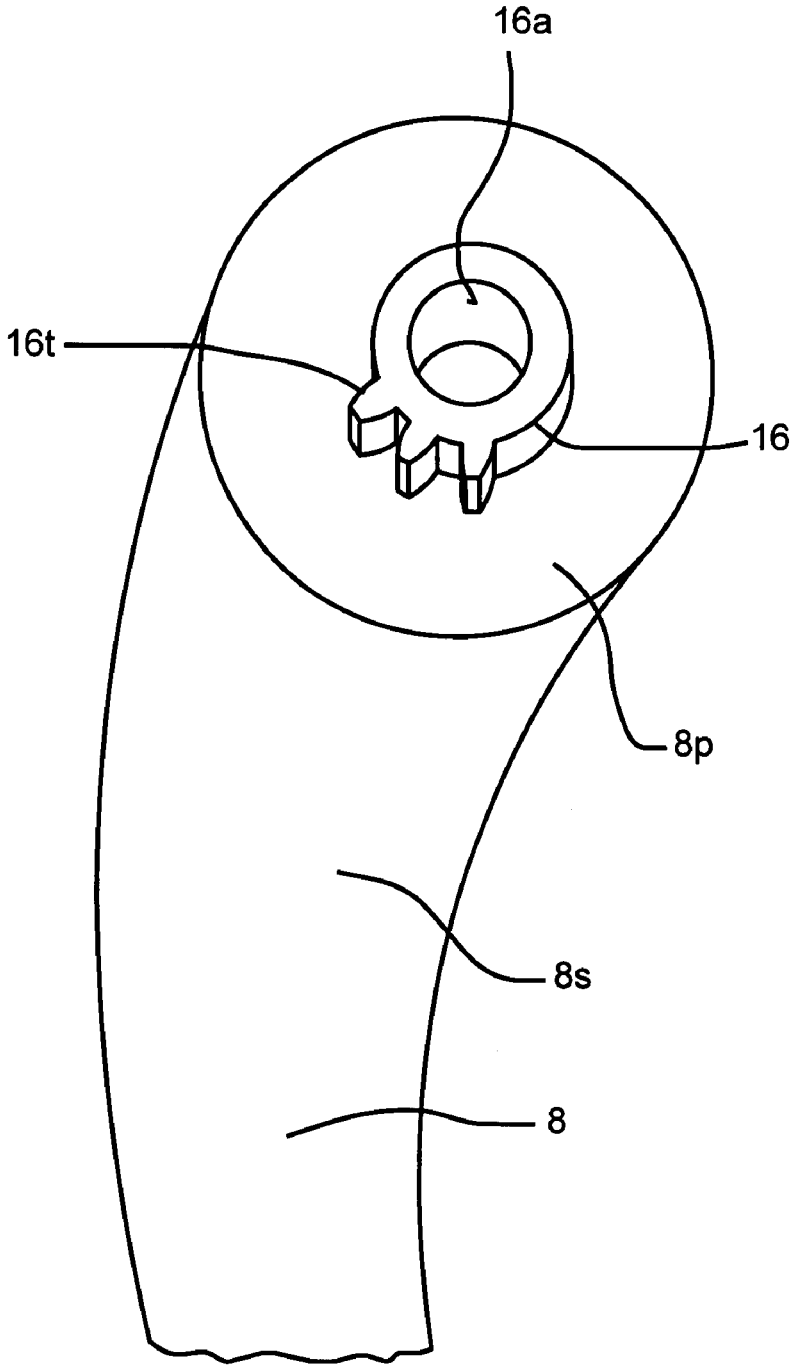
FIG. 5 is a partial, perspective view of an operative handle and an integral pinion gear of the hand held tool shown in FIG. 4.
Figure 6:
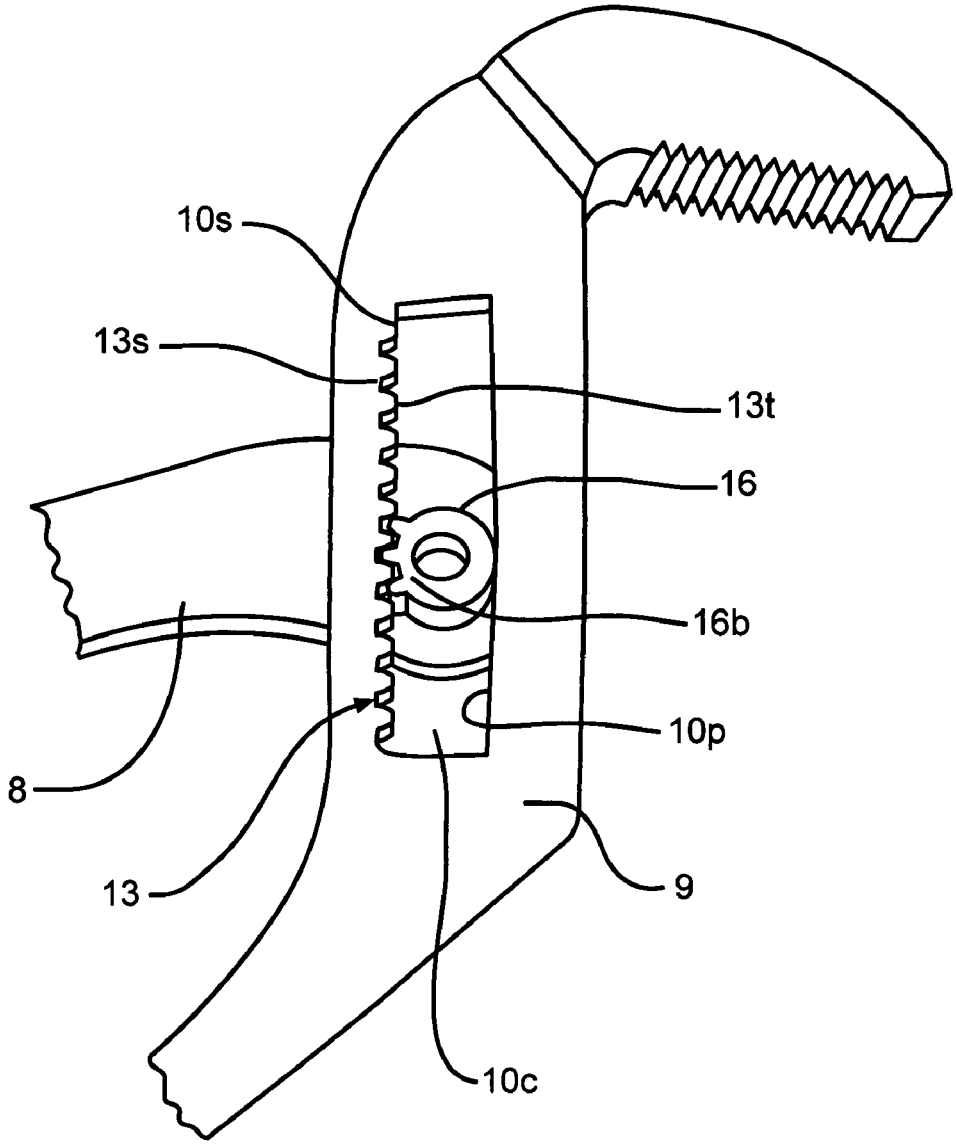
FIG. 6 is a partial perspective view of the hand held tool of FIG. 4 showing an operative jaw removed and a partially-toothed pinion gear in engagement with a rack.

The operative handle 8 also includes a pinion gear 16, as best seen in FIGS. 5 and 6, which is operatively mounted to the jaw end 8*p* of the operative handle 8. The pinion gear 16 is axially positioned within the slot 10 to slideably move in the slot 10. It should be understood, however, that other means of securing the pinion gear 16 to the jaw end 8*p* of the operative handle 8 are within the contemplated scope of the present invention.

In the embodiment shown, a post member 15 and a nut 12 secures the operative handle 8 to the slotted handle 9. FIG. 6 shows the Plier Assembly PA with the post member 15 removed. The pinion gear 16 includes at least one, and in certain embodiments, a plurality of teeth 16*t*, which are suitably shaped to engage the spaces 13*s* between the teeth 13*t* of the rack 13. In FIG. 6, the pinion gear 16 is shown engaging the rack 13 in a set, or engaged, position.

The slotted handle 9 has a jaw, or pivot, end 9*p* and a gripping end 9*g*. The pivot end 9*p* defines a jaw 9*j*. The jaw end 9*p* of the slotted handle 9 defines a slot 10. The slot 10 extends along a medial section 9*m* of the slotted handle 9. The slot 10 has a first side 10*s* which defines a toothed side, or rack, 13 and a second, or plain, side 10*p*. The toothed rack 13 defines a plurality of alternating teeth 13*t* and spaces 13*s*.

Figure 4:
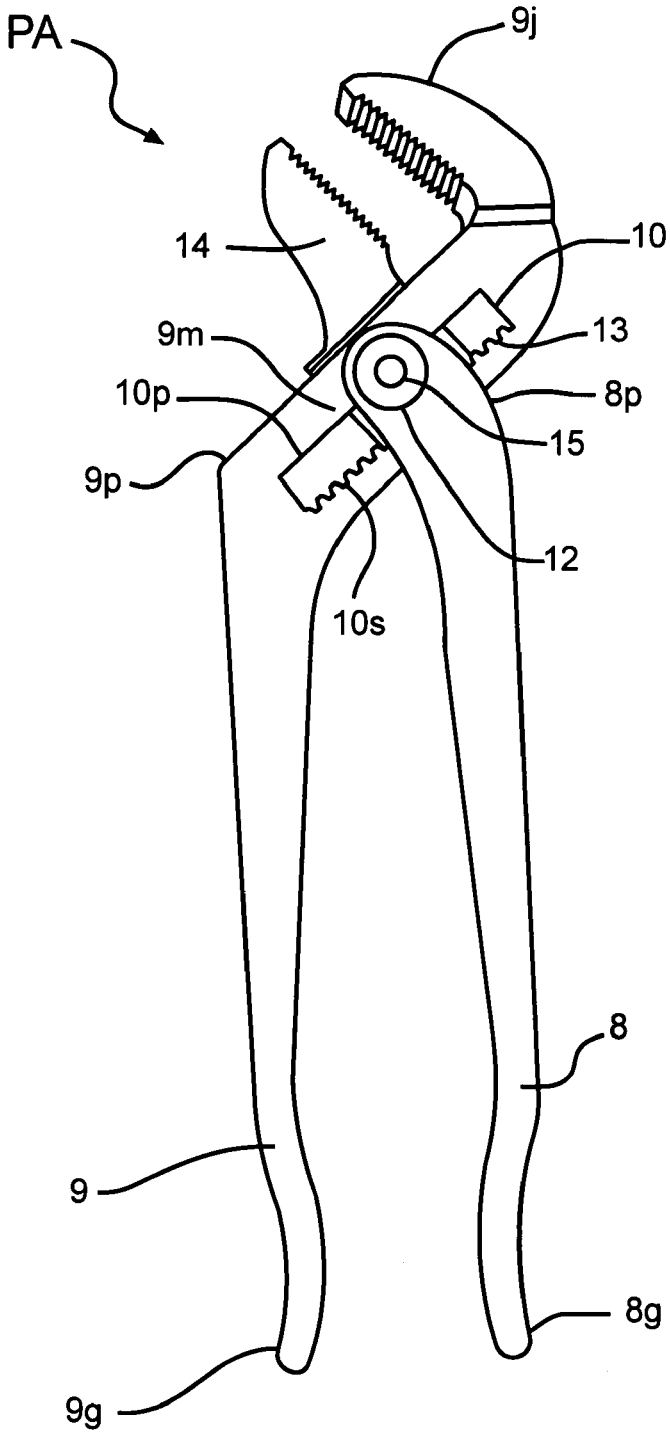
FIG. 4 is a top plan view of another hand held tool.

In the embodiment shown, the post member 15 extends through a flanged portion 14*f* of the operative jaw end 14. As seen in FIG. 4, the nut 12 is coaxially mounted on the post member 15. The post member 15 secures the jaw end 9*p* of the slotted handle 9 to the operative jaw 14 of the operative handle 8.

Figure 7:
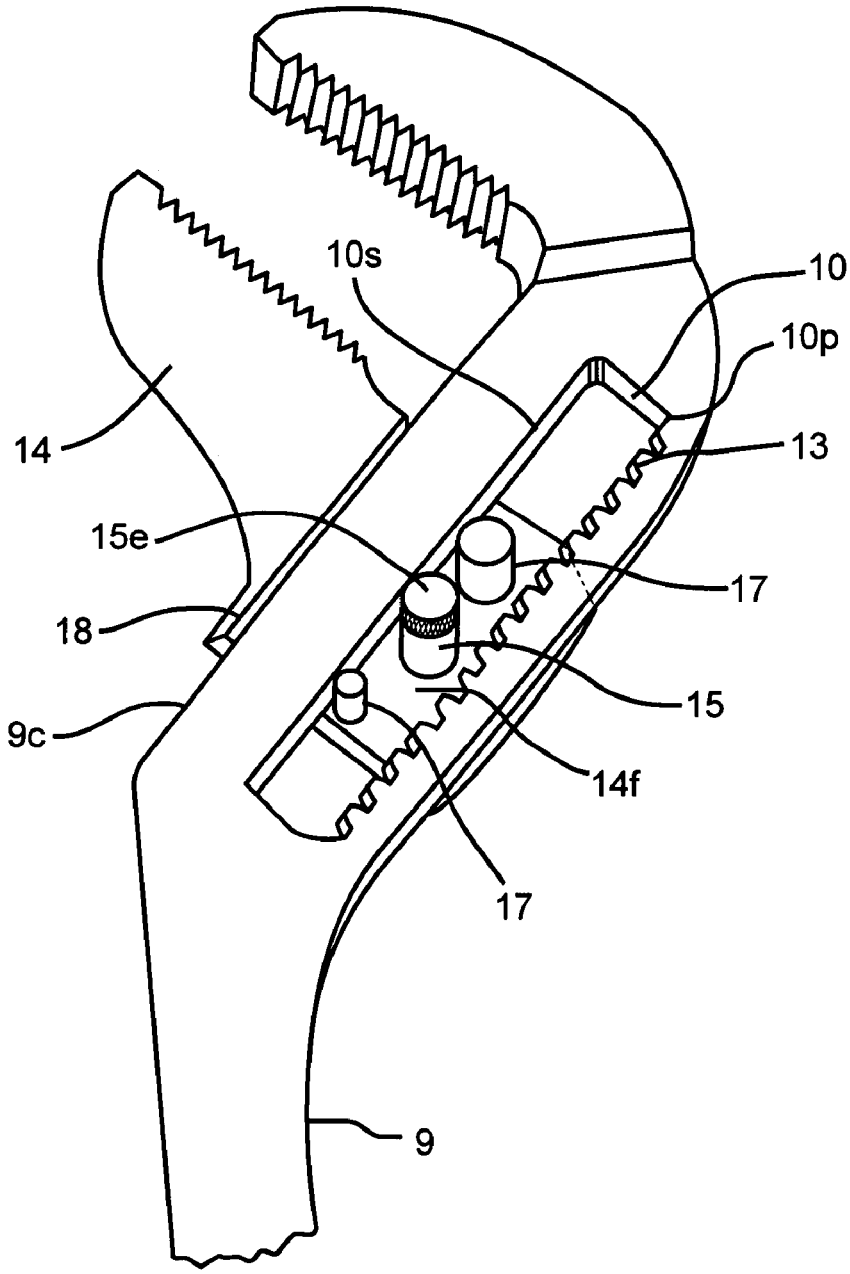
FIG. 7 is a partial, perspective view of the hand held tool of FIG. 4 showing an operative handle removed.

FIG. 7 shows a portion of the handle 8, that is, the operative jaw 14 with the handle portion 8*p*-8*g* of the operative handle 8 removed. In the embodiment shown, the jaw 14 preferably features the threaded-end post 15 which extends from the interior face 14*f* and passes through an axially extending bore 16*a* in the partially-toothed pinion gear 16. The 12 nut preferably threads onto an end of the post member 15. It is to be understood that other suitable connecting members are within the contemplated scope of the present invention for securing one part of a pivoting tool to an adjacent part of such tool, for example; the tool assembly may be made by means of a swaged shoulder with a counter bore in an opposing part of the tool to provide a low profile surface on such tool.

Further, in certain embodiments, the operative jaw 14 can include at least one or more guiding mechanisms such guide projections 17 and/or guide ledge 18. As shown in FIG. 7, adjacent the post member 15 there is at least one, and in certain embodiments, two or more suitable structural projections 17 (such as, by way of non-limiting examples: plain posts, bosses, ridges, steps, tongues, or other elements which project into the cavity formed by the slot 10). The projections 17 extend in a spaced apart and parallel relationship to the post member 15. The projections 17 do not interfere with the rotation of the partially-toothed pinion gear 16. The projections(s) 17, in cooperation with the ledge 18, prevents rotation of the operative jaw 14 when a clamping action is performed on a workpiece. The projection(s) 17 are in sliding contact with the elongated smooth surface 10*s* of the slot 10 opposite the rack 13, while ledge 18 of the jaw 14 is in sliding contact with a cooperating surface 9*c* on an exterior face of the slotted jaw handle 9. It is to be understood that other types of guide mechanisms, including, but not limited to low profile bearings, can be used to reduce any resistance, and the use of such are within the contemplated scope of the present invention.

Referring now, in particular to FIG. 6, the pinion gear 16 is axially positioned to move in the slot 10. FIG. 6 shows the operative jaw 14 removed where the pinion gear 16 is shown in engagement with the rack 13.

The pinion gear 16 includes at least one, and in certain embodiments, a plurality of teeth 16*t*, which are suitably shaped to engage the spaces 13*s* between the teeth 13*t* of the rack 13. In FIG. 6, the pinion gear 16 is shown engaging the rack 13 in a set, or engaged, position. FIG. 6 shows the plier assembly PA in an engaged position where the teeth 16*t* of the pinion gear 16 are engaged, or in mating contact, with the teeth 13*t* of the rack 13.

In the embodiment shown in FIGS. 4-7, a very high jaw force augmentation is achieved by the rack and pinion gear pivot-and-translate mechanism. The partially-toothed pinion gear 16 is in rolling contact with the rack 13 which allows the plier assembly PA to have a very desirable short output (jaw) moment arm. The jaw augmentation forces achieved with the present invention are nearly as great as a true toggle plier, without the disadvantage of the prior art toggle pliers' "snap-action" clamp-release characteristic, which "snap-action"requires a separate release action by the user.

The position of the rack 13 is reversed from the rack 3 of the embodiment shown in FIGS. 1-3. Instead of comprising the jaw-side of the elongated slot, the rack 13 is incorporated into a side 10*p* that is the opposite, elongated, side of the jaw-handle slot 10.

The plier assembly PA comprises a 2-piece jaw-handle, the operative handle 8 and the jaw 14. The 2-piece jaw-handle, comprising the handle 8 and jaw 14, is pivotably joined at a pivot axis of the pinion gear 16. This provides a very compact and efficient design. The operative handle 8 is positioned on the one side of the slotted jaw handle 9, while its operative jaw 14 is positioned on the opposite side of the slotted jaw handle 9. The 2-piece jaw-handle comprised of the operative handle 8 and the jaw 14 move together in a rectilinear fashion.

The partially-toothed pinion gear 16 is integrally attached or incorporated into the operative handle 8's interior facing side 8*s*. The rack and pinion gear pivot mechanism makes shortening of the operative jaw's moment arm, the quasi-toggle action, and a sequential jaw gap setting procedure possible. The partially-toothed pinion gear 16 is integral with the jaw end 8*p* of the operative handle 8 and cooperates with the rack 13 and slot 10 in the slotted handle 9. The pinion gear toothed 16*t* preferably comprise about 90 degrees, or ¼ of the gear's total circumferential distance in order to permit the familiar and desirable sequential jaw gap setting procedure. The rest of the circumference of the gear 16 is left toothless (down to the root diameter). The diameter of the pinion gear 16 corresponds to the nominal width of the slot 7.

The gear teeth 16*t* are aligned with the jaw-handle 8 such that when the handles 8 and 9 are separated at nearly their widest separation distance, the body 16*b* of the pinion 16 is aligned with a centerline 10*c* of the slot 10. The gear teeth 16*t* are no longer in engagement with the adjacent rack 13, thereby enabling the operative jaw handle 8 and jaw 14, along with the pinion gear 16, to be slid along the slot 10 until arriving at a new jaw gap position. Once the new jaw position is reached, the operative jaw handle 8 and jaw 14 are once again rotated into an operative position. Once the operative jaw-handle 8 and jaw 14 rotated into the operative position, the pinion gear teeth 16*t* are then in engagement with a new set of the rack's teeth 13*t*. The new set of teeth 13*t* correspond to a different jaw gap setting, thereby retaining the desirable sequential jaw gap setting procedure.

The rack teeth 13*t* define the elongated side 10*p* of the slot 10 farthest from the jaws 8*j*. The near side 10*s* of the slot 10 is left plain. The plier assembly PA is made to operate by moving the handle 8 and the handle 9 in a direction toward each other such that the jaws 8*j* and 9*j* close upon each other. The operative jaw-handle 8 and jaw 14 together with the pinion gear 16 creates a rolling-translating pivot axis (i.e., prolate cycloid motion) which coincides with the rack's straight-line pitch dimension, as fully described above.

The jaw's moment arm pivot axis is offset toward the jaw by one half of the pitch diameter of the pinion gear 16. This effectively shortens the jaw's moment arm length and increases its jaw force. One advantage is that the lower jaw's moment arm no longer extends all the way to the centerline of the elongated slot as is the case in prior art slip-joint pliers.

Since the operative handle 8 and the jaw 14 are joined in a pivoting fashion, as the operative handle 8 is rotated, the jaw 14 is also made to move in a rectilinear fashion. This unitary movement provides a satisfactory feel when using the tool. Additionally, since the operative handle 8 and the jaw 14 pivot on one another, and not side-by-side, the plier assembly PA has a very compact construction.

In the embodiment shown in FIGS. 4-7, the distal face of the pinion gear 16 is not seated against another surface. Since the operative jaw 14 is not made to rotate, there is a small clearance between the end of the partially-toothed pinion gear 16 and the inside face of the operative jaw 14.

Very high jaw augmentation forces are achieved due to the potential for very short effective jaw moment arm lengths. The rolling action of the pinion gear 16 provides the necessary jaw travel, even with a low pinion/rack gear tooth profile. This jaw travel is better than the limited travel which is afforded by a stationary pivot axis and tang approach. Also, the plier assembly PA allows for a consistently high jaw force regardless of the operative handle's position, which can be an advantage in some applications. In addition to the leverage advantage a short moment arm allows, the rolling action of the partially-toothed pinion gear on the rack gear, which transfers its force through the preferably threaded post, is more efficient than the dual tang, cam-action, approach used by prior type tools.

Another advantage is that the plier assembly PA has an open construction and does not trap debris. While a non-separable, press-fit (or other permanent retention means), end cap may optionally be used in place of the threaded nut, the rack threads are sufficiently accessible to be cleaned, if necessary, without disassembly of the major part. Also, for example, all major parts of the plier assembly P and PA may be made from forged metal or by blanked laminations for greater strength and for lower costs of production.

Still other the advantages afforded include:

sequential jaw gap setting procedure; very high jaw force augmentation; non-toggle action (fast operation, easy release); a compact design; low post construction; a parallel jaw orientation; a design suitable for use in dirty conditions; a design that is easy to clean; an efficient force transfer design between the operative handle and its jaw; and, a satisfactory feel when using the tool.

Figure 8:
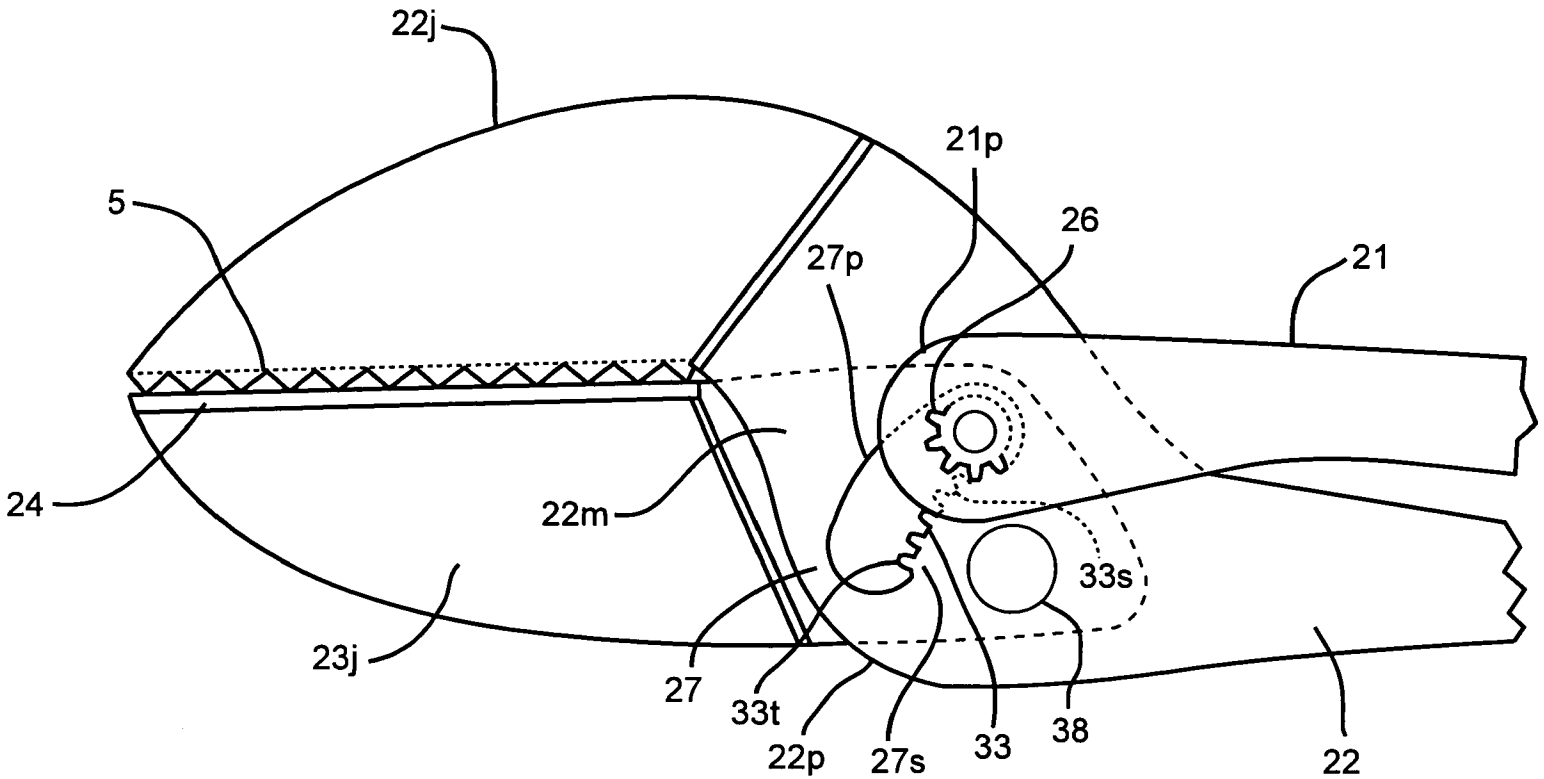
FIG. 8 is a partial, plan view, partially in phantom, showing an alternative embodiment which features a curved slot.

FIG. 8 depicts an alternative embodiment of a tool, such as a snip Assembly SA, which includes an operative handle 21 and a slotted handle 22. The operative handle 21 has a jaw, or pivot, end 21*p* and a gripping end (not shown) and a pinion gear 26. The pivot end 21*p* is operatively attached to a lower jaw 23*j*.

The slotted handle 22 has a jaw, or pivot, end 22*p* and a gripping end (not shown). The pivot end 22*p* defines a straight knife blade edge 24*j*. The jaw 22*p* of the slotted handle 22 defines a curved slot 27. The curved slot 27 extends along a medial section 22*m* of the slotted handle 22. The curved slot 27 has a first side 27*s* which defines a toothed side, or rack, 33 and a second, or plain, side 27*p*. The toothed rack 33 defines a plurality of alternating teeth 33*t* and spaces 33*s*.

The pinion gear 26 engages the curved slot 27 and the gear teeth 33*t*, in a manner as described above for the other embodiments The lower jaw 23 pivots about a stud 38.

The slotted handle 22 features a combination of serrations 24 and an anvil 25. The anvil 25 comprises a groove extending down the middle of the serrations 24. In certain embodiments, the serrations 24 comprise a straight knife blade edge which seats against the anvil surface 5. In the embodiment shown in FIG. 8, the lower jaw 23*j* is shown in the fully closed position. In many such embodiments, the shown snip Assembly, or looper, SA is designed to cut twigs and branches with minimal effort. The serrations prevent the branch from sliding out from the nip point while the anvil surface 25 allows the blade 24 to make a clean cut. One advantage of the curved slot 27 and rack 33 is that, as the slotted handle 22 approaches its closed position, the force delivered by the jaws increases dramatically due to the pivoting action of the lower jaw 23*j*. This increase in jaw force near the closure of the tool handily coincides with a requisite increase in force needed to complete the cut.

It should be noted that the present invention is not limited to the examples shown. For example, various iterations of the partially-toothed pinion gear and operative jaw have been contemplated which include the optional use of cam-followers to further reduce sliding friction and pinion gears with teeth that do not span the full width of the gear.

Additional advantages may include one or more of the following: a tool that retains a desirable parallel jaw orientation (as opposed to a wrap-around jaw orientation style) while improving on the developed clamping force exerted by the jaws on the workpiece; a tool that retains a desirable jaw orientation while lessening the hand grip force required to achieve an equivalent jaw clamping force; a tool that has a substantial increase in a jaw's grip over that of conventional slip-joint pliers such that the tool of the present invention is less apt to slip off, or round the corners, of hexagonal nuts, bolts, and the like; a tool that retains a sequential-action jaw gap setting action, which may include the steps of first spreading the handles to their nearly widest separation distance, and then adjusting the jaw by a rectilinear sliding action, and finally closing or partially closing the handles to the desired jaw gap, thereby setting the tool for the workpiece for the task at hand; a hand tool which can be used in dirty conditions, and can be easily cleaned, assembled, and disassembled; a low cost, compact plier design; a tool that has an extremely high jaw force that does not require a locking-toggle action since locking toggle pliers and wrenches are much slower to operate due to the need for a change of grip in order to release the toggle-lock mechanism; and a tool that has an increased number of jaw gap position settings over known pliers and wrenches.

Figure 17:
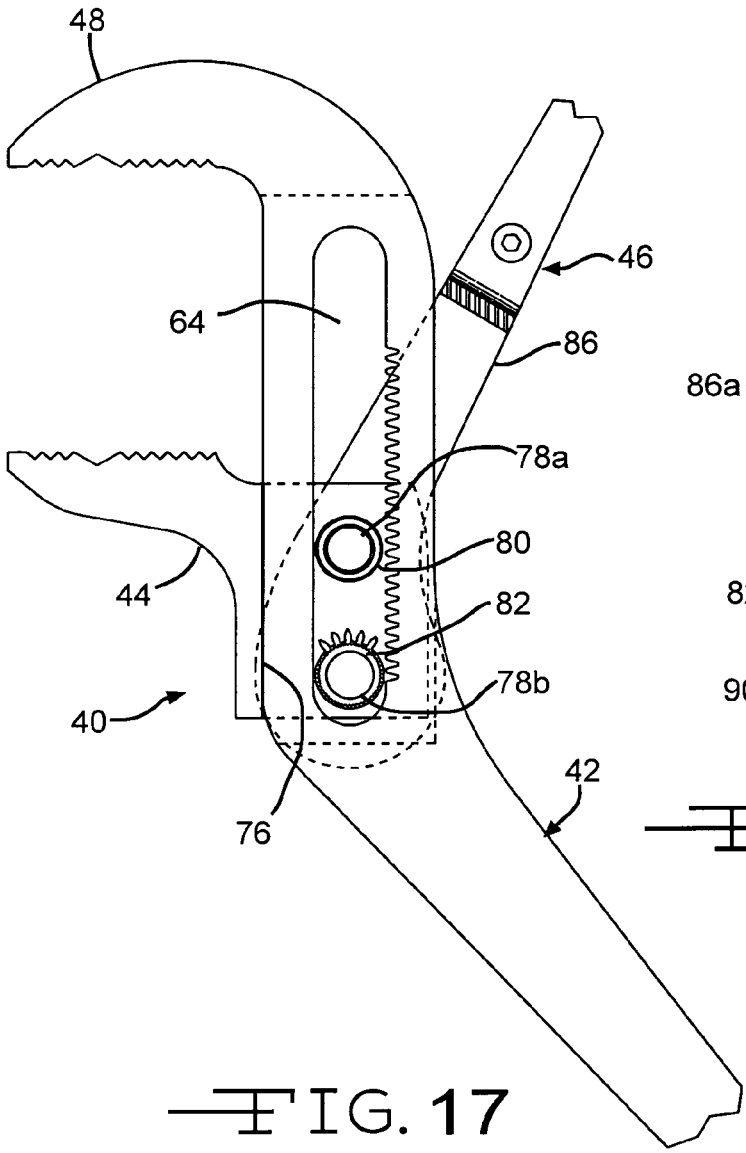
FIG. 17 is a plan view of the pliers of FIG. 10, including the operative handle.
Figure 18:
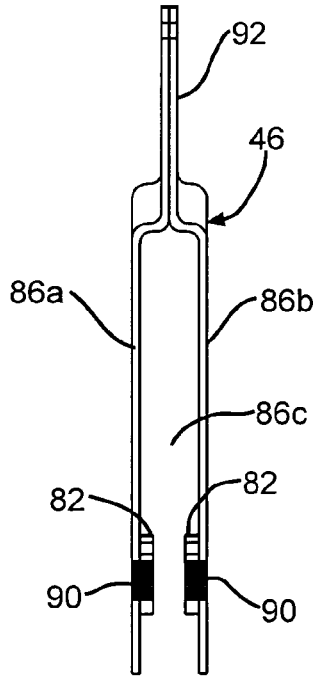
FIG. 18 is a side view of FIG. 17.

In another embodiment, as shown in FIGS. 10-13, a hand held tool 40 includes a slotted handle 42 and an operative jaw 44 slidably mounted with respect to the slotted handle. Further, as shown in FIGS. 17 and 18, the tool 40 includes an operative handle 46. The slotted handle 42 includes an upper or fixed jaw 48 at a jaw end 50, a medial section 52 and a gripping end 54 defining a handle 56. The fixed jaw 46 includes a gripping edge 58, which can have any surface suitable for gripping a workpiece. As shown in FIG. 13, the slotted handle 42 is configured in a laminated manner, with at least the medial section 52 having two spaced apart layers or laminations 52*a* and 52*b*. Also, the fixed jaw 48 is comprised of two spaced apart jaws 48*a* and 48*b*, laminated together with a middle jaw plate 60. The gripping end 54 is also configured as two spaced apart portions 54*a* and 54*b*, laminated together by a spacer 62.

The medial section 52 includes a slot, indicated generally at 64. Slot 64 actually is comprised of slots 64*a* and 64*b* in the medial section laminations 52*a* and 52*b*, respectively. The slot 64*a* and 64*b* each include a gear tooth rack 66 defining a plurality of alternating teeth and spaces. As can be seen in FIG. 13, the slotted handle in the end or side view includes left lamination 68*a* (defined by the jaw 48*a*, medial portion 52*a* and handle portion 54*a*) and right lamination 68*b* (defined by the jaw 48*b*, medial portions 52*b* and handle portion 54*b*). The left lamination 68*a* is separated by the right lamination 68*b*, thereby defining a slotted handle slot 68*c*.

As shown in FIG. 11, the operative jaw 44 includes a jaw arm 70 having a gripping edge 72, and a tongue 74. A shoulder 76 is defined where the jaw arm 70 narrows to the width of the narrower tongue 74. The shoulder 76 is useful in maintaining the operative jaw in alignment with the slot 64. The operative jaw 44 also includes upper and lower alignment rods 78*a* and 78*b* that protrude perpendicularly from the faces of the tongue 74. The upper alignment rod 78*a* supports a bearing 80 for guiding the operative jaw 44 as it slides along the slot 64. The lower alignment rod 78*b* acts as an axle and leverage point for a partially toothed pinion gear 82. The pinion gear can have any number of teeth that cooperate with the rack 66 to drive the operative jaw along the slot 64. As shown, the teeth encompass about 90 degrees of the circumference of the pinion gear, although the teeth can extend to a greater or lesser arc.

As can be seen in FIGS. 17 and 18, the shoulder 76 in combination with the bearing 80 and the pinion gear 82 acts as a guide mechanism to maintain the orientation of the operative jaw 44 with respect to the slot 64 as the operative jaw 44 slides and as torque is applied to the operative jaw when a workpiece is gripped. The upper guide mechanism element shown engages the smooth side of the near side slot. This can be bearing press-mounted on a round rod which, in turn, is fixed to the tongue of the jaw. The near-side partially toothed pinion gear can include a spline to securely fix the pinion gear to the handle by braze-welding, press-fitting, or any other mechanism.

Figure 16:
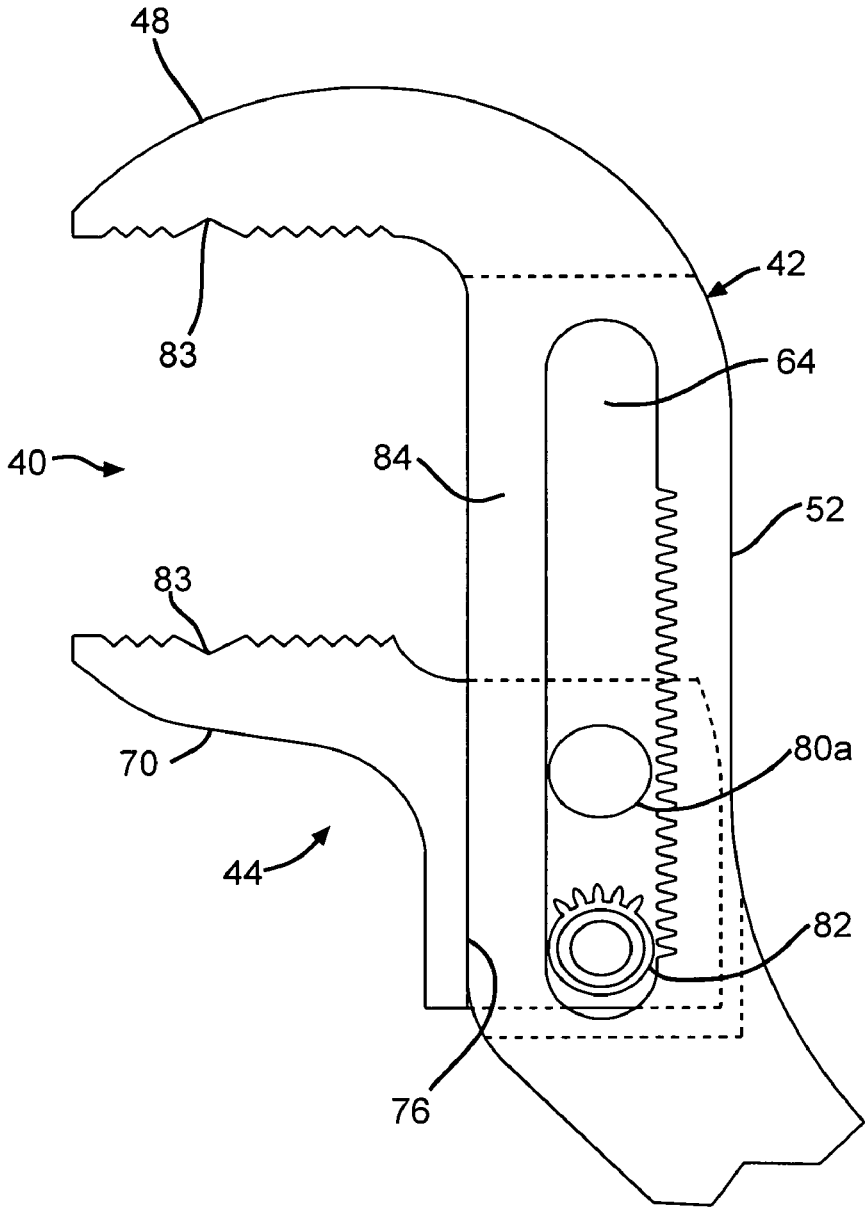
FIG. 16 is a plan view of pliers similar to that shown in FIG. 10, with the operative handle removed.

The guide mechanism can be of any structure that maintains the alignment of the jaw when in operation. For example, the alignment mechanism can include a rod of larger diameter than the rod 78*a*, such as the larger diameter rod 80*a* shown in FIG. 16. The upper jaw guide mechanism element 80*a* consists of a double-ended round rod fixed with respect to the jaw tongue. The pinion gear (included handle not shown) is pivotably mounted to a lower, double-ended, rod 78*b* and rotated such that the jaw may be slid to a new jaw gap setting. The jaws 48 and 44 include optional shallow 120 degree included-angle notches 83 for gripping onto the corners of hex fasteners for speed tightening and loosening purposes, and, to prevent marring of decorative hexagonal surfaces.

Rod 80*a* down not need a bearing such as the bearing 80 shown in FIG. 17. Other guide mechanism can be used. One additional guide mechanism, not shown, includes a shoulder 76 on each side of the medial land 84 (shown in FIG. 16) of the medial section 52, or alternatively on each side of the entire medial portion 52, also not shown.

The operative handle 46 includes a split section 86, including portions 86*a* and 86*b*, as shown in FIG. 18. The operative handle pivots on the pins 78*b*, not shown in FIG. 18, with the pins extending through the holes 90. At the distal end of the handle 46 is the handle grip 92.

In summary with respect to the embodiment shown in FIGS. 10-15 and 17-18, the operative jaw 44 includes optional serrations to grip a workpiece. Two vertical shoulders, or ledges, to act as part of a jaw guide mechanism. A tongue section cooperates with the third slot of the slotted handle. The jaw has bearings mounted on the projecting ends of a fixed rod which passes through the operative jaw's tongue (the second bearing is hidden from view on the reverse side of the tongue). The bearings act as another part of the guide mechanism for the jaw. The bearing guide allows the jaw 44 to move smoothly when the jaw is being used to grip a workpiece, or, when a jaw gap adjustment is being made. The two partially-toothed pinion gears, one hidden from view, is only meant to indicate the lower mounting location of those parts. While not shown in FIG. 10, each half of the split operative handle has a partially-toothed pinion gear which projects from the interior face of the handle at the pinion gear end and engages their respective slots in the outer plates. Therefore, the pinion gear would not normally be shown without its companion handle. The smooth (non-toothed) portion of the pinion gears cooperates with the smooth side of their respective slots and are the final jaw guide elements.

Figure 19:
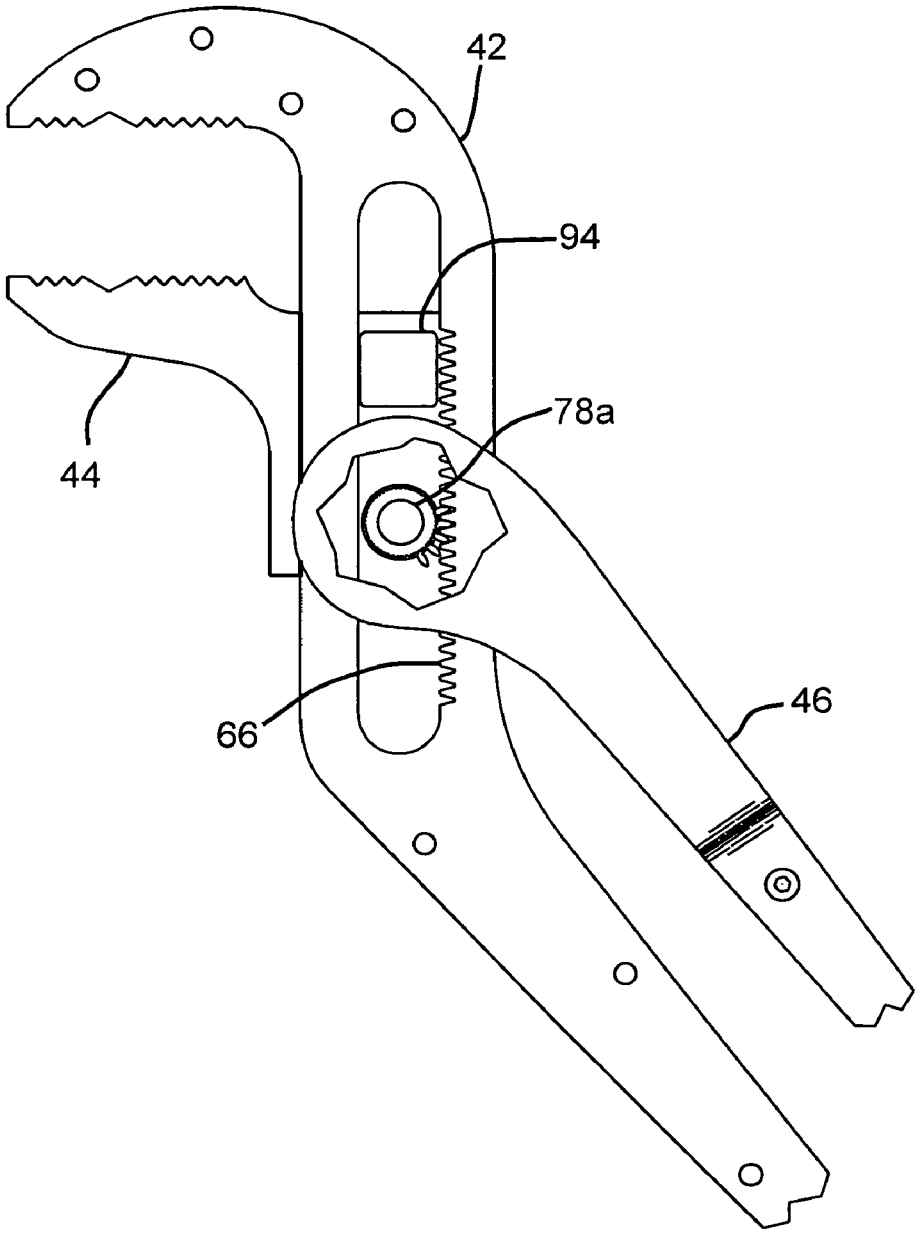
FIG. 19 is a plan view of another embodiment of an adjustable pliers having a slidably mounted jaw.
Figure 20:
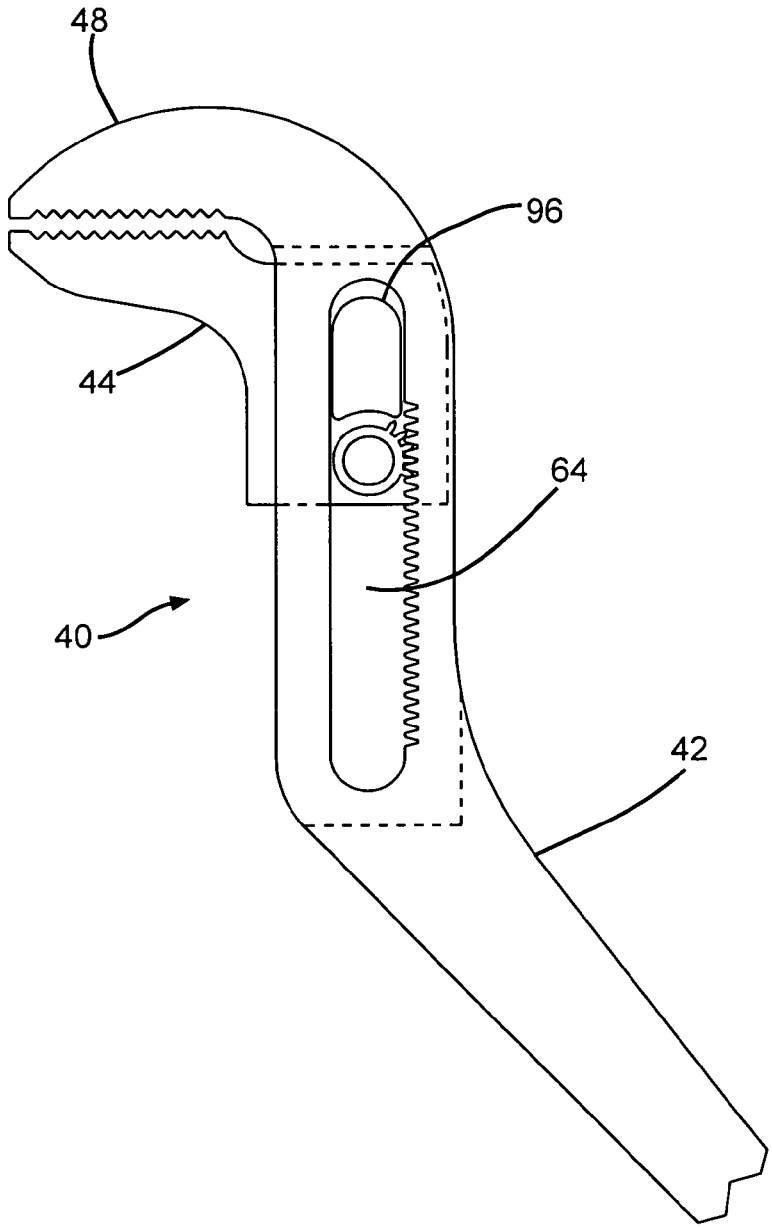
FIG. 20 is a plan view of another embodiment of an adjustable pliers having an alternate guide mechanism.
Figure 21:
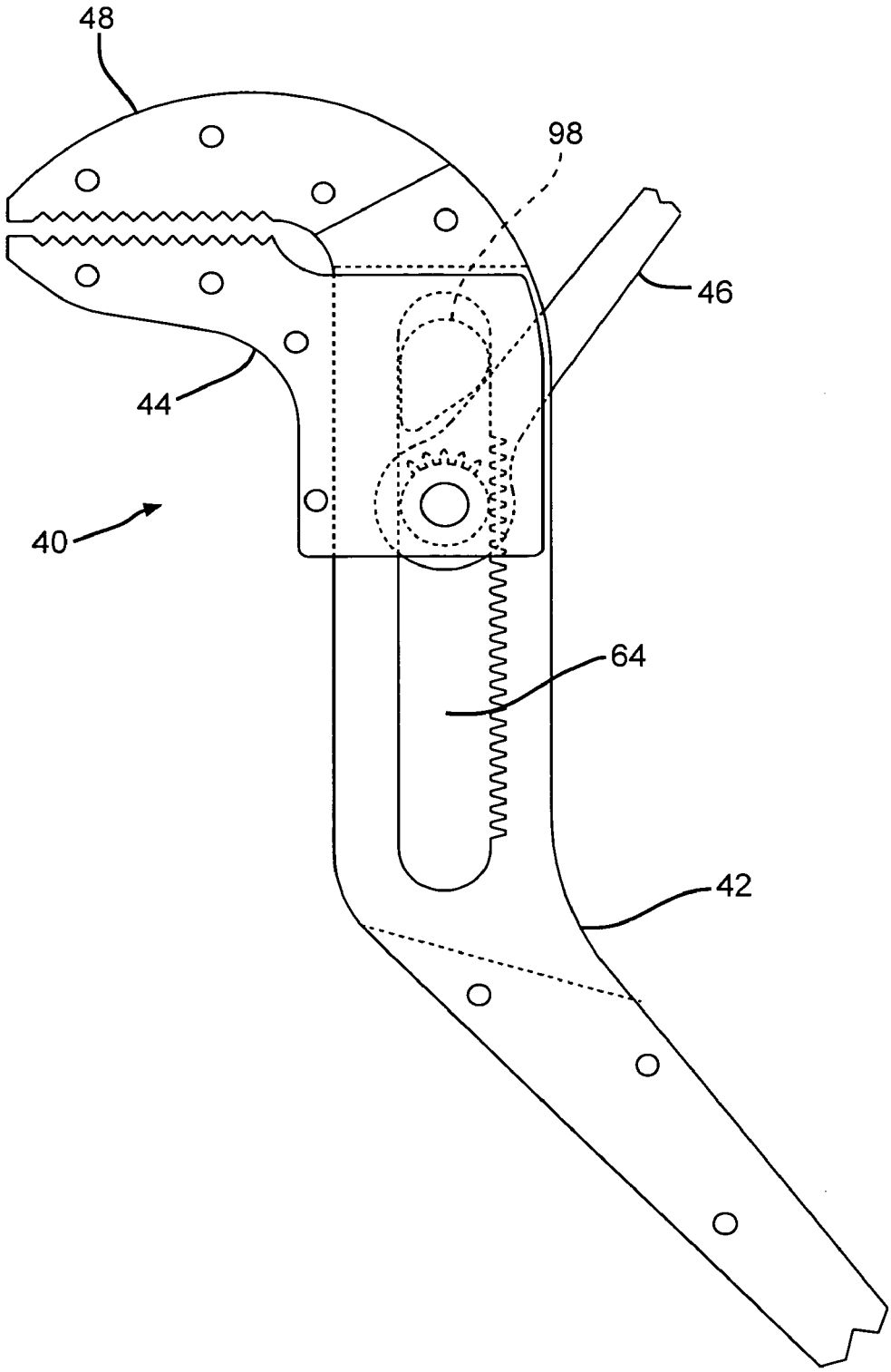
FIG. 21 is a plan view of yet another embodiment of an adjustable pliers having an alternate guide mechanism.

In FIG. 19 the hand held tool 40 is shown with the pinion gear teeth engaging the rack 66. A guide substantially square member 94 is positioned in the slot 64 as part of the guide mechanism to maintain the orientation of the jaw 44 with respect to the slot as the jaw slides. Yet another shape of a an element used in the guide mechanism is shown at 96 in FIG. 20. An additional guide element 98 is shown in FIG. 21.

Figure 10:
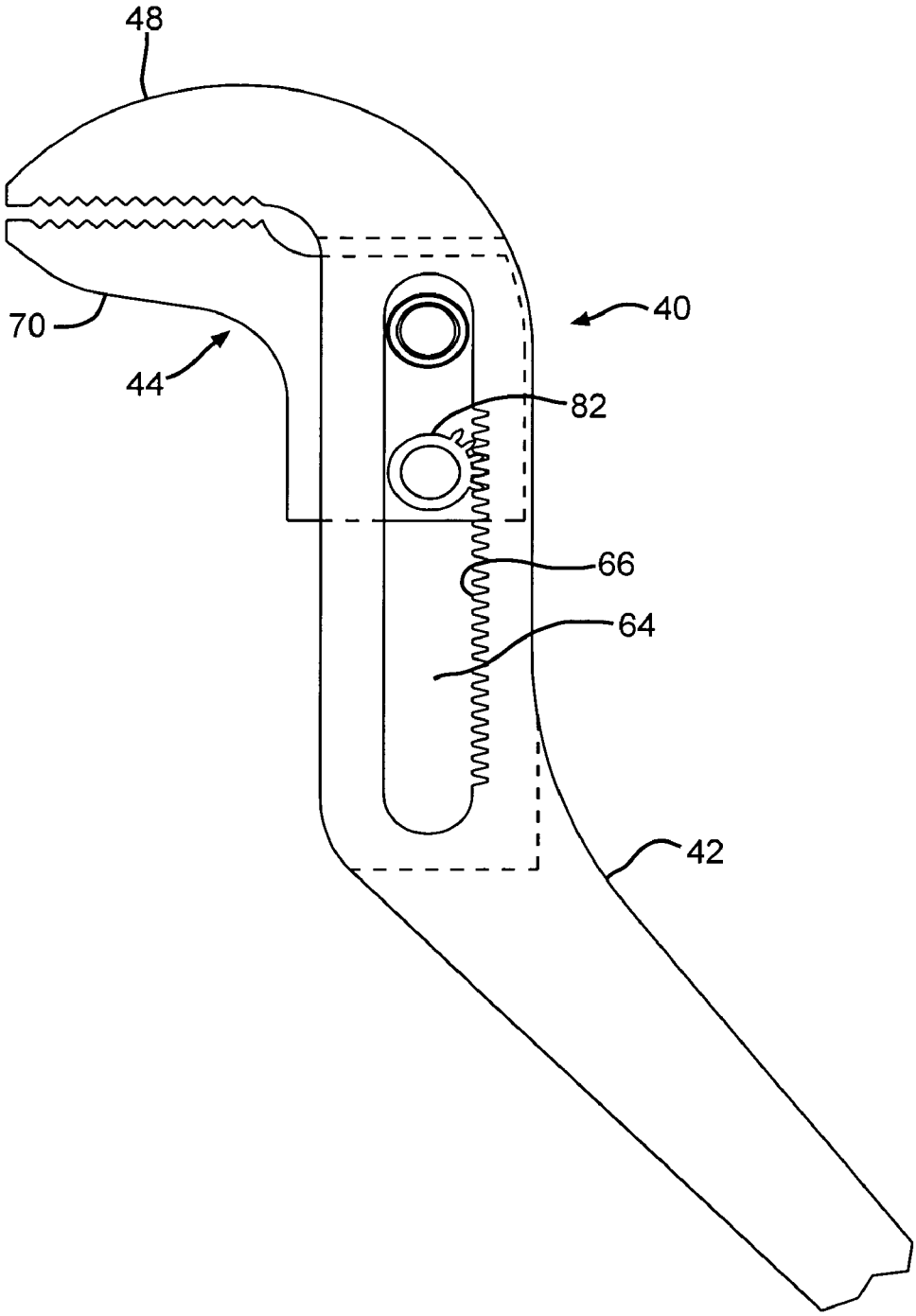
FIG. 10 is a plan view of an adjustable pliers having a slidably mounted jaw, with the operative handle removed.

The slotted handle 42, while shown to be laminated, may be machined from a single, monolithic part. FIG. 10 depicts a slotted handle comprised of four plates, preferably punched to shape from flat steel plates, and subsequently laminated together. Two identical plates are punched to the overall profile seen in the front elevation view and comprise the outer two plates in the laminated, 3-high stack. Each of these two plates includes a slot 64*a*, 64*b* in which the one straight side of the slot is smooth, and the opposite side, furthest from the jaw end, is partially toothed with the gear tooth rack. The two outer plates sandwich the two middle plates. The two middle plates are separated from one another in the laminated stack such that a third, cross-wise, slot 68*c* is formed between the interior end surfaces of the two middle plates and the two spaced-apart outer plates. The interior end of the jaw-end middle plate is the upper hidden line in the front elevation view. The lower hidden line in the same view is the interior end of the handle-end middle plate.

The operative jaw 44 is shown separated from the laminated slotted handle 42. The operative jaw 44 itself may, or may not, be laminated. The operative jaw is depicted in FIG. 10 can machined, forged, cast, metal-injection-molded, or powder-pressed and sintered as one monolithic part, or made in another suitable manner.

The embodiments described above depict two jaw guide mechanism elements and a partially toothed pinion gear which occupy a single slot in the slotted handle. Generally, the partially toothed pinion gear is situated in the space between the two jaw guide elements and is primarily used to engage the gear tooth rack. In a different embodiment, the smooth (non-toothed) portion of each pinion gear functions as the lower one of two jaw guide mechanism elements which occupy each slot. Therefore, the latter embodiments's jaw guide mechanism consists of a pair of two upper elements, and a pair of two lower elements. There are several possibilities for the design of the upper pair of jaw guide elements which engage the slotted handle's two slots as depicted in the accompanying drawings. These include: needle bearing cam-followers, cylindrical posts or rods, elongated bosses or pads with clearance for the pinion gears' teeth, and tear-drop shapes.

Figure 26:
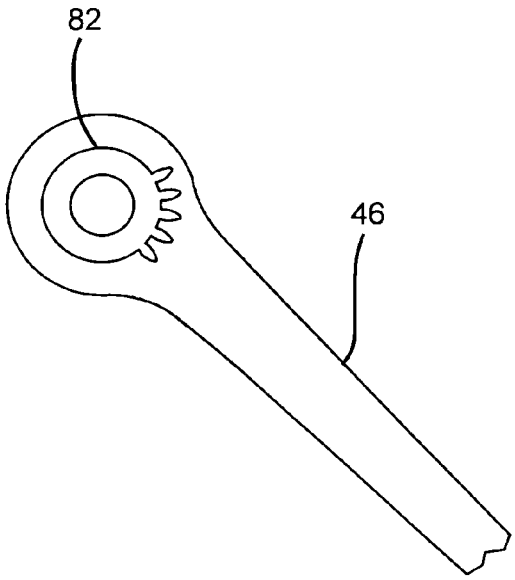
FIG. 26 is a plan view of the operative handle of the tool of FIG. 22.
Figure 27:
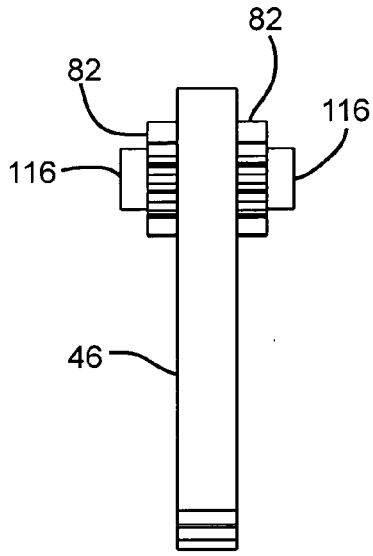
FIG. 27 is a side view of the operative handle of FIG. 26.

In the embodiment shown in FIGS. 23-27, the is a balanced, symmetrical construction. When viewed edge-on, it is readily apparent that the structure, and hence, the distribution of force, is symmetrical and balanced around the centerline of the tool. The tool shown in FIGS. 23-27 is similar in many respects to that shown in earlier drawings. The medial section 52 of the slotted handle 42 includes the slot 64, which is shown as individual slots 64*a* and 64*b* in FIG. 25. The two jaw plates 48*a* and 48*b* in FIG. 25 are spaced outside the slotted handle laminations 42*a* and 42*b*. Outer plates 100 provide a smooth outer profile, the width of the jaw 40. An upper spacer 60 sets the width of the jaw. A handle spacer 102 maintains the separation of the slotted handle laminations 42*a* and 42*b*. The operative jaw 44 includes a tear drop-shaped upper guide member 104 having a substantially flat surface 106 to engage the side of the slot 64. as shown in FIG. 24, a spacer 108 spaces the two cheek plates 110. The operative handle 46 is shown in FIGS. 26 and 27. Pinion gears 82 include shafts 116.

The laminated type hand tool opens up the possibility of low manufactured cost and certain other advantages due to the ability to quickly punch out fully shaped laminations with little or no post-machining work required. Also, a laminated construction allows the use of high strength steel only where it is needed, and, selective induction hardening of wear surfaces. This embodiment shares the same high jaw force, the rolling motion, and similar operation enjoyed by the earlier embodiments.

In summary with respect to FIGS. 23-27, the laminated operative jaw has two cheek plates 110 which extend back from the sides of the jaw end and surround the sides of the slotted handle 42 at its slotted medial section 52. The operative jaw cheek plates 110 have two guide members 104, between the two cheek plates, which extend inwardly and engage the first two slots 42*a* and 42*b* of the slotted handle. The two upper, tear-drop shaped, jaw guide mechanism elements 104 (even though only one is visible), and two lower holes 114 (even though only one is visible) cooperate with the operative handle's partially toothed pinion gear journal ends in order to locate the handle and transfer force from the optative handle's partially toothed pinion gear teeth to the operative jaw 44. The operative jaw laminations may be riveted, or welded together after the jaw has been assembled to the slotted and operative handles.

As in previous embodiments, the coarse jaw gap adjustment is made by opening the handles to their widest separation distance, sliding the operative jaw to a new jaw gap setting, and once again bringing the operative and slotted handles together.

Figure 28:
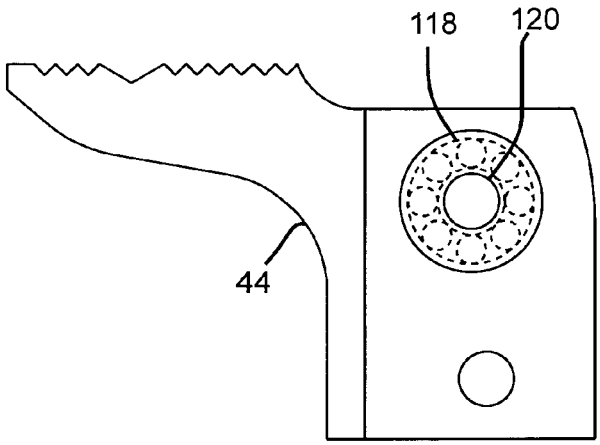
FIG. 28 is a plan view of another operative jaw.
Figure 29:
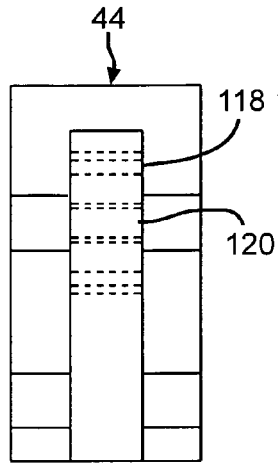
FIG. 29 is a side view of the jaw of FIG. 28.

As shown in FIGS. 28 and 29, the guide mechanism can include a bearing element 118 in which the rod 120 is mounted. This design allows easy sliding of the operative jaw.

The principle and mode of operation of this invention have been described in its preferred embodiments. However, it should be noted that this invention may be practiced otherwise than as specifically illustrated and described without departing from its scope.

What is claimed is:

1. A hand held tool comprising:

a slotted handle having a jaw end, a medial section, and a gripping end, wherein the jaw end defines a jaw, the medial section includes a slot having a gear tooth rack, the toothed rack defining a plurality of alternating teeth and spaces, and the gripping end defining a handle;

an operative handle having a pinion gear end and a gripping end, wherein the pinion gear end includes a pinion gear fixed with respect to the operative handle, the pinion gear being positioned in the slot, the pinion gear having a toothed portion and a non-toothed portion, the toothed portion having at least one tooth shaped to engage the spaces of the gear tooth rack in a rolling motion, and the non-toothed portion being structured to enable sliding of the pinion gear along the slot when the pinion gear teeth are not engaged with the gear tooth rack; and an operative jaw slidably mounted with respect to the slotted handle to cooperate with the jaw of the slotted handle to grip a workpiece, the operative jaw having one or more guide mechanisms to maintain the orientation of the jaw with respect to the slot as the jaw slides and as torque is applied to the operative jaw when a workpiece is gripped, the jaw having a post member fixed to the jaw and extending through the pinion gear to pivotally mount the pinion gear with respect to the slotted handle.

2. The tool of claim 1 in which the slot has the gear toothed rack on one side and a smooth surface on another side, wherein the gear tooth rack side of the slot is the side closest to the handle end.

3. The tool of claim 1 in which the guide member includes at least one ledge and at least one pin, with the ledge and pin being positioned to guide the jaw as it slides along the slot.

4. The tool of claim 1 in which the guide member includes two ledges.

5. The tool of claim 1 in which the pinion gear includes at least two teeth.

6. The tool of claim 1 in which the pinion gear has a toothed portion that constitutes about 90 degrees of the circumference of the pinion gear, with the remainder of gear being non-toothed.

7. The tool of claim 1 in which the slot has a width and the pinion gear has a root diameter that corresponds to the nominal width of the slot.

8. The hand held tool of claim 1, wherein the pinion gear is integrally formed with the operative handle.

* * * * *